United States Patent [19]

Sunada et al.

[11] Patent Number: 4,568,573

[45] Date of Patent: Feb. 4, 1986

[54] PROCESS OF FORMING A FILM OF FLUORINE-CONTAINING RESIN ON A METALLIC SUBSTRATE

[75] Inventors: Yukiyoshi Sunada; Shigeya Hanazono, both of Tokyo; Hiroshi Ikeda, Higashi-Kanamachi, all of Japan

[73] Assignee: Nikken Toso Tokyo Company, Limited, Tokyo, Japan

[21] Appl. No.: 703,085

[22] Filed: Feb. 19, 1985

[51] Int. Cl.[4] ..... B05D 3/02; B05D 3/12

[52] U.S. Cl. ..... 427/350; 427/374.1; 427/388.2; 427/398.4

[58] Field of Search ..... 427/350, 374.1, 374.6, 427/388.2, 398.4; 428/421, 422, 463

[56] References Cited

U.S. PATENT DOCUMENTS

| | | | |
|---|---|---|---|
| 4,147,821 | 4/1979 | Young | 427/350 X |
| 4,264,650 | 4/1981 | Schulze et al. | 427/388.2 X |
| 4,421,781 | 12/1983 | Reznik | 427/350 X |

*Primary Examiner*—Michael R. Lusignan
*Attorney, Agent, or Firm*—Martin Smolowitz

[57] ABSTRACT

A process of forming a film of a fluorine-containing resin on a surface of a metallic substrate, wherein the substrate is coated with the fluorine-containing resin and is placed in a furnace vacuumized to a predetermined degree within a range containing the order of $10^{-3}$ Torr. The vacuumized atmosphere in the furnace is heated at a predetermined heating temperature of the range of from about 330° C. to about 420° C. for a predetermined period of time, whereupon the hot vacuumized atmosphere in the furnace is allowed to cool spontaneously with a vacuum of preferably the same degree maintained in the furnace until the temperature in the furnace reaches a predetermined pre-quenching temperature lower than the heating temperature and, thereafter, an inert gas at ambient temperature is introduced into the furnace for quenching the coating on the substrate.

23 Claims, No Drawings

PROCESS OF FORMING A FILM OF FLUORINE-CONTAINING RESIN ON A METALLIC SUBSTRATE

FIELD OF THE INVENTION

The present invention relates to a process of forming a hardened coating or film of a fluorine-containing resin on a surface of a metallic substrate.

BACKGROUND OF THE INVENTION

While a process according to the present invention is useful for the formation of a film of a fluorine-containing resin on any of various forms of metallic substrates, the advantages of the process, which are to be clarified as the description proceeds, will be exploited most effectively where the film to be formed on the substrate is required to provide high degrees of hardness, adhesion to substrate, non-stickiness, surface-to-surface fitness, smoothness, water repellency, wear and abrasion resistances, scratch resistance, corrosion resistance, and/or resistances to stress and strain. In the description to follow, the substrates which can be treated by a process according to the present invention will be exemplified by thermal fixation rolls of duplicating machines; castings, especially of aluminum and aluminum alloys, which are represented by certain kinds of cooking utensils or vessels to be subjected to heat such as kettles, pots and pans; certain kinds of machine components of precision, optical and other machines and equipment such as precision cutting knives or blades of metal and non-metal working machines and fins of heat exchangers; certain kinds of precision articles of metal such as needles of syringes; and component members of some machines and equipment such as soldering jigs and molds for forming thermoplastic and thermosetting plastics.

A thermal fixation roll of a duplicating machine is a hollow cylinder of metal used for the thermal fixation of tonor particles. It is constructed usually of an aluminum alloy, copper, or steel and ordinarily measures from about 30 cm to about 60 cm in diameter and from about 320 cm to about 400 cm in length as well known in the art. Such a thermal fixation roll of a duplicating machine typically has its outer peripheral surface uniformly coated with polytetrafluoroethylene or polytetrafluoroethylene/perfluoropropyl vinyl ether copolymer. Problems have thus far been pointed out in connection with the films of polytetrafluoroethylene and polytetrafluoroethylene/perfluoropropyl vinyl ether copolymer thus applied to the outer peripheral surfaces of thermal fixation rolls presently in use.

The film of, for example, polytetrafluoroethylene applied to the outer peripheral surface of a thermal fixation roll is acceptable in hardness but has a drawback in that, when the roll is to be coated with polytetrafluoroethylene with a film of silicon oil preliminarily applied to the surface of the roll, the silicon oil infiltrates into the porosities in the film and is caused to expand and form a myriad of swells or blisters on the surface of the roll when the roll is subjected to rapid heating. Formation of these swells or blisters seriously impairs the strength of adhesion of the film to the surface of the substrate and surface-to-surface fitness, smoothness, water repellency, wear and abrasion resistances, scratch resistance, and resistances to stress and strain of the film and results not only in shortened durability and accordingly in shortened lifetime of the roll per se but in deterioration in the performance quality of the duplicating machine using such a roll.

On the other hand, the coating of polytetrafluoroethylene/perfluoropropyl vinyl ether copolymer applied to the outer peripheral surface of a thermal fixation roll is a thin film of the thickness of from about 20 microns to about 40 microns having a significantly small number of porosities and is for this reason practically free from the problem encountered by the film of polytetrafluoroethylene. A drawback of the film of polytetrafluoroethylene/perfluoropropyl vinyl ether copolymer is that it has a degree of hardness corresponding to the grades B to 2B in terms of pencil lead hardness and is inferior in this respect to the film of polytetrafluoroethylene which has a degree of hardness corresponding to the grade F or HB of the pencil lead hardness although the hardness of each of the films may vary depending upon the thickness of the film. The coating of polytetrafluoroethylene/perfluoropropyl vinyl ether copolymer applied to a thermal fixation roll is thus unacceptable in hardness, adhesion to substrate, non-stickiness, surface-to-surface fitness, smoothness, wear and abrasion resistances, scratch resistance, and resistances to stress and strain and may also degrade the performance quality of the duplicating machine using the roll.

Numerous variants of a process of coating the surface of a thermal fixation roll with polytetrafluoroethylene, polytetrafluoroethylene/perfluoropropyl vinyl ether copolymer or a copolymer of polytetrafluoroethylene and polyhexafluoropropylene have therefore been proposed to provide solutions to these problems. Representative examples of these variant processes are disclosed in Japanese Provisional Patent Publications No. 54-127447, No. 54-149745, No. 56-93517 and No. 56-133770 which are herein cited as references. One of the processes taught in these published materials uses polytetrafluoroethylene as a primer over which particles of polytetrafluoroethylene/perfluoropropyl vinyl ether copolymer are applied to form a non-sticky film on the outer peripheral surface of a thermal fixation roll. For the formation of such a film, the outer peripheral surface of the roll to be processed is roughened in an appropriate manner and a primer of polytetrafluoroethylene is applied to the roughened outer surface of the roll. The roll thus having the powder of the polytetrafluoroethylene/perfluoropropyl vinyl ether copolymer applied to the film of the primer on the surface of the roll is heated to fuse the copolymer under atmospheric pressure or in a vacuumized furnace. During sintering of the coating of the polytetrafluoroethylene/perfluoropropyl vinyl ether copolymer, the primer underlying the coating being heated tends to produce stains on the surface of the coating and degrades the various properties of the resultant coating of the copolymer as well as the external appearance of the coated article. If an aminosilane is used as a primer to avoid formation of such stains on the coating of the polytetrafluoroethylene/perfluoropropyl vinyl ether copolymer, the resultant coating will fail to have a sufficient strength of adhesion to the surface of the roll which is to be frequently subjected to heat for an extended period of time.

On the other hand, the coatings of fluorine-containing resins on castings of aluminum and aluminum alloys to be used as some cooking vessels such as kettles, pots and pans are generally required to have high degrees of hardness, adhesion to substrate or to primer, non-stickiness, smoothness, wear and abrasion resistances, scratch resistance, corrosion resistance, and resistances to stress and strain. Various processes are known for the formation of coatings of fluorine-containing resins on castings in general of aluminum and aluminum alloys. These processes are largely broken down into two major categories: the processes using primers or undercoats and the processes forming the coatings of the fluorine-containing resins directly on the surfaces of the castings. In one of the processes of the latter type, the surface of a casting of aluminum or an aluminum alloy is etched in a solution of an inorganic acid such as typically hydrochloric acid, hydrofluoric acid or phosphoric acid or of a mixture of two or more of these at an ambient temperature or at an appropriately elevated temperature. The surface of the casting thus roughened by chemical etching is anodized to form an oxidized corrosion resistant layer thereon, whereupon a dispersed solution of a fluorine-containing resin is applied to the resultant surface of the casting. The casting is then heated to a temperature higher than the melting point of the fluorine-containing resin to form the desired film of the fluorine-containing resin on the roughened, corrosion resistant surface of the aluminum or aluminum-alloy casting. Another process of forming a film of a fluorine-containing resin on an aluminum or aluminum-alloy casting without use of a primer involves electrolytic etching in an aqueous solution of a halogenide such as typically sodium chloride or potassium chloride to have the surface of the casting roughened to a desired degree.

Having recourse to formation of an undercoat of polyhexafluoropropylene or aminosilane on the surface of the article to be coated with a fluorine-containing resin is objectionable since such a primer tends to produce stains on the surface of the coating or the coating formed on the primer tends to fail to have an adequate strength of adhesion to the surface of the substrate, as discussed previously.

Where a casting of an aluminum alloy is used as the substrate on which the film of a fluorine-containing resin is to be formed in any of the known processes dispensing with the use of primers, the proportion of the element aluminum in the alloy is short of assuring effective anodic oxidation of the casting so that it is difficult to form a sufficiently stabilized corrosion resistant layer in the surface of the casting to be coated with the fluorine-containing resin. This problem is more serious where the aluminum alloy used contains another alloy component such as silicon since the existence of such an additional alloy component promotes production of smuts on the surface of the casting upon acid pickling of the surface. Aluminum or aluminum alloys of only limited types have for these reasons been thus far used as the substrate on which a coating of a fluorine-containing resin is to be formed without using a primer.

During chemical or electrolytic etching of the surface of a casting of aluminum or an aluminum alloy as above discussed, the chemical etchant or the electrolytic solution is allowed to penetrate into the fine porosities or concavities formed in the roughened surface of the casting. The chemical solution thus trapped into these porosities or concavities in the casting can not be removed completely by mere repetition of rinsing in water. If the solution fails to be removed from the casting completely, the small quantities of the solution remaining in the porosities or concavities of the casting produce stains or discolored spots on the film of the fluorine-containing resin formed on the surface of the casting and also degrade the external appearance of the coating per se and accordingly the commercial value of the coated article. In the worst case, the presence of the chemical etchant or the electrolytic solution left in the porosities or concavities might result in formation of a layer of a hydroxide (which is usually called rust in the art) on the surface of the aluminum or aluminum-alloy casting. The formation of such a layer in turn results in shortened lifetime of the aluminum or aluminum-alloy article.

As noted previously, a process according to the present invention is applicable also to the formation of a coating of polytetrafluoroethylene on the surface of any of certain kinds of machine components of precision, optical and other machines and equipment such as precision cutting knives or blades of metal and non-metal working machines and fins of heat exchangers, certain kinds of precision articles of metal such as needles of syringes, and component members of some machines and equipment such as certain kinds of soldering jigs and molds for forming thermoplastic and thermosetting plastics. Various processes are also known for the formation of such coatings on substrates of, for example, aluminum, an aluminum alloy, mild steel, stainless steel or brass (a zinc-copper alloy). To form a film of polytetrafluoroethylene on the surface of such a substrate in one of the known processes, the substrate is preliminarily etched either chemically or electrolytically and a dispersed solution of polytetrafluoroethylene is applied to the surface thus roughened of the substrate and is heated at an atmospheric or subatmospheric pressure to form a hardened solid layer of polytetrafluoroethylene on the surface of the substrate. In a process using a primer, polyhexafluoropropylene, alkyl titanate or an aminosilane is applied to the roughened surface of the substrate whereupon a dispersed solution of polytetrafluoroethylene is applied to the primer thus formed preliminarily on the surface of the substrate. None of these processes is however fully acceptable for producing a uniform coating of polytetrafluoroethylene satisfactory for any of the above enumerated articles. Where the substrate to be coated is in the form of a cast product of, for example, an aluminum alloy which has an abundance of cavities or porosities in the surface layer, the coating may fail to be formed in the cavities or porosities and will, as a result produce irregularities of thickness throughout its area.

It is, accordingly, an important object of the present invention to provide an improved process of forming a film of a fluorine-containing resin on the surface of a metallic substrate to achieve increased degrees of hardness, adhesion to a substrate, non-stickiness, surface-to-surface fitness, smoothness, water repellency, wear and abrasion resistances, scratch resistance, corrosion resistance, and/or resistances to stress and strain.

It is another important object of the present invention to provide an improved process of forming a film of a fluorine-containing resin on the surface of a metallic substrate such as a thermal fixation roll of a duplicating machine, wherein the process is adapted to preclude formation of swells or blisters on the surface of the coating of the fluorine-containing resin when the coating on the substrate is subjected to rapid heating in the presence of silicon oil.

It is still another important object of the present invention to provide an improved process of forming a film of a fluorine-containing resin on the surface of a metallic substrate such as a thermal fixation roll of a duplicating machine, wherein the process is adapted to preclude production of stains on the surface of the coating during heating of the coating on the substrate.

It is still another important object of the present invention to provide an improved process of forming a film of a fluorine-containing resin on the surface of a metallic substrate without having recourse to the formation of a primer or undercoat on the surface of the substrate.

It is still another important object of the present invention to provide an improved process of forming a film of a fluorine-containing resin on the surface of a casting of, particularly, aluminum or an aluminum alloy, wherein the surface of the substrate to be coated with the fluorine-containing resin is mechanically roughened prior to being anodized to form an oxidized corrosion resistant layer so that there will be no chemical solution trapped in the porosities or concavities formed in the casting during the roughening step.

It is still another important object of the present invention to provide an improved process of forming a film of a fluorine-containing resin on the surface of a casting of aluminum or an aluminum alloy in such a manner that there will be produced on the film of the fluorine-containing resin no such stains or discolored spots that will degrade the external appearance of the coating per se and accordingly the commercial value of the coated article.

It is still another important object of the present invention to provide an improved process of forming a film of a fluorine-containing resin on the surface of a casting of aluminum or an aluminum alloy in such a manner that there will not be produced on the surface of the casting a layer of hydroxide which will contribute to reduction in the lifetime of the coated aluminum or aluminum-alloy article.

It is still another important object of the present invention to provide an improved process of forming a film of polytetrafluoroethylene on the surface of any of certain kinds of machine components of precision, optical and other machines and equipment such as precision cutting knives or blades of metal and non-metal working machines and fins of heat exchangers, certain kinds of precision articles of metal such as needles of syringes, and component members of some machines and equipment such as soldering jigs and molds for forming thermoplastic and thermosetting plastics.

It is still another important object of the present invention to provide an improved process of forming a satisfactorily uniform film of polytetrafluoroethylene on the surface of any of these precision members and articles.

Yet it is still another important object of the present invention to provide an improved process of forming a film of a fluorine-containing resin on the surface of a metallic substrate to achieve excellent mechanical properties of the coating and an excellent external appearance of the coated article.

SUMMARY OF THE INVENTION

In accordance with a prime aspect of the present invention, there is provided a process of forming a film of a fluorine-containing resin on a surface of a metallic substrate, comprising the steps of (a) coating the surface of the metallic substrate with the fluorine-containing resin, (b) placing the coated metallic substrate in a vacuum furnace, (c) developing in the vacuum furnace a partial vacuum of a predetermined degree within a range containing the order of $10^{-3}$ Torr, (d) heating the vacuumized atmosphere in the furnace at a predetermined heating temperature of the range of from about 330° C. to about 420° C. for a predetermined period of time, (e) upon lapse of the aforesaid predetermined period of time, allowing the hot vacuumized atmosphere in the furnace to cool spontaneously while maintaining a vacuum within the aforesaid range in the furnace until the temperature in the furnace reaches a predetermined pre-quenching temperature lower than the aforesaid predetermined heating temperature, (f) introducing an inert gas at ambient temperature into the furnace for quenching the coating on the substrate.

In accordance with one subordinate yet outstanding aspect of the present invention, there is provided a process of forming a film of polytetrafluoroethylene/-perfluoropropyl vinyl ether copolymer on a surface of a metallic substrate, comprising the steps of (a) coating the surface of the metallic substrate with polytetrafluoroethylene/perfluoropropyl vinyl ether copolymer, (b) placing the coated metallic substrate in a vacuum furnace, (c) developing in the vacuum furnace a partial vacuum of a predetermined degree within the range of from the order of $10^{-3}$ Torr to the order of $10^{-1}$ Torr, (d) heating the vacuumized atmosphere in the furnace at a predetermined heating temperature of the range of from about 330° C. to about 400° C. for a predetermined period of time, (e) upon lapse of the aforesaid predetermined period of time, allowing the hot vacuumized atmosphere in the furnace to cool spontaneously while maintaining a vacuum within the aforesaid range in the furnace until the temperature in the furnace reaches a predetermined pre-quenching temperature lower than the aforesaid predetermined heating temperature, the aforesaid predetermined pre-quenching temperature being within the range of from about 310° C. to about 360° C., (f) introducing an inert gas at ambient temperature into the vacuum furnace for quenching the coating on the substrate.

In accordance with another subordinate yet outstanding aspect of the present invention, there is provided a process of forming a film of a fluorine-containing resin on a surface of an aluminum or aluminum-alloy substrate, the fluorine-containing resin being selected from the group consisting of polytetrafluoroethylene/-polyhexafluoropropylene copolymer and polytetrafluoroethylene/perfluoropropyl vinyl ether copolymer, the process comprising (a) roughening the surface of the substrate, (b) anodizing the roughened surface of the substrate (c) coating the anodized surface of the substrate with the fluorine-containing resin, (d) placing the coated substrate in a vacuum furnace, (e) developing in the vacuum furnace a partial vacuum of a predetermined degree within the range of from the order of $10^{-3}$ Torr to the order of $10^{-1}$ Torr, (f) heating the vacuumized atmosphere in the furnace at a predetermined heating temperature of the range of from about 330° C. to about 400° C. for a predetermined period of time, (g) upon lapse of the aforesaid predetermined period of time, allowing the hot vacuumized atmosphere in the furnace to cool spontaneously while maintaining a vacuum within the aforesaid range in the furnace until the temperature in the furnace reaches a predetermined pre-quenching temperature lower than the aforesaid predetermined heating temperature, the aforesaid predetermined pre-quenching temperature being within the range of from about 310° C. to about 360° C. (h) introducing an inert gas at ambient temperature into the vacuum furnace for quenching the coating on the substrate.

In accordance with still another subordinate yet outstanding aspect of the present invention, there is provided a process of forming a film of polytetrafluoroethylene on a surface of a metallic substrate, comprising the steps of (a) coating the surface of the metallic substrate with polytetrafluoroethylene, (b) placing the coated metallic substrate in a vacuum furnace, (c) developing in the vacuum furnace a partial vacuum of a predetermined degree within the range of the order of $10^{-3}$, (d) heating the vacuumized atmosphere in the furnace at a predetermined heating temperature of the range of from about 380° C. to about 420° C. for a predetermined period of time, (e) upon lapse of the aforesaid predetermined period of time, allowing the hot vacuumized atmosphere in the furnace to cool spontaneously while maintaining a vacuum within the aforesaid range in the furnace until the temperature in the furnace reaches a pre-quenching temperature lower by a predetermined value than the aforesaid predetermined heating temperature, the aforesaid predetermined pre-quenching temperature being within the range of from about 310° C. to about 360° C., the aforesaid predetermined value being within the range of from about 40° C. to about 100° C., (f) introducing an inert gas at ambient temperature into the vacuum furnace for quenching the coating on the substrate.

In a process according to the present invention as above described, the vacuum in the furnace is preferably maintained at the aforesaid predetermined degree while the hot vacuumized atmosphere in the furnace is being allowed to cool upon lapse of the aforesaid predetermined period of time.

Using a vacuum within the range of the order of from $10^{-3}$ Torr to the order of $10^{-1}$ Torr in a process according to the first or second aspect of the present invention is important for producing a uniformly smooth, hardened film of a fluorine-containing resin firmly adhered to the surface of a metallic substrate. If a vacuum of a degree lower than the order of $10^{-1}$ Torr is used, the fluorine-containing resin applied to the surface of the substrate and melted by heat could not be properly admitted into the porosities or concavities in the surface and would fail to form a film having an adequate strength of adhesion to the surface of the substrate and an adequate degree of hardness. If, on the contrary, a vacuum of a degree higher than the order of $10^{-3}$ Torr is used, then the fluorine-containing resin applied to the surface of the substrate could not be melted uniformly on the surface of the substrate during the heating step and would fail to form a film with an adequate degree of smoothness during the quenching step especially when the fluorine-containing resin used is of the type having a relatively high degree of viscosity in a melted state. The surface roughness of such a film is such that it can not be remedied even if the film is contacted and quenched by atmospheric air while the fluorine-containing resin on the substrate still remains in a melted state after the film is heated. At any rate, using vacuums of degrees higher than the order of $10^{-3}$ Torr is economically unfeasible in the present technological state of the art.

It has been known that particles of a synthetic resin applied to the surface of a metallic substrate can be thermally melted to form a smooth film by strictly controlling the pressure of the atmosphere in which the substrate is to be placed, as well as the heating temperature and the viscosity to which the synthetic resin is to be melted ("Journal of Japan Society of Colour Materials", Vol. 55, pp 382, 1982). The technique having a coating of a fluorine-containing resin heated on the surface of a metallic substrate in vacuumized atmosphere to form an excellent hardened film on the surface is however proposed for the first time by the present invention.

Using a heating temperature within the range of from about 330° C. to about 420° C. in a process according to the present invention is also important for producing a film of a fluorine-containing resin with satisfactory mechanical properties. If the heating temperature used is lower than about 330° C., the coating of the fluorine-containing resin applied to the surface of a metallic substrate could not be melted sufficiently and admitted properly and uniformly into the porosities or concavities in the surface of the substrate during the heating step and would fail to form a hardened film with an adequate degree of adhesion to the surface of the substrate during the quenching step. The use of a heating temperature higher than about 420° C. would provide a desired strength of adhesion of the resultant film to the surface of a metallic substrate but will result in an inadequate degree of hardness of the film formed on the substrate. Such reduction in the hardness of the film may result from decomposition of the fluorine-containing resin due to application of an unduly high temperature to the resin.

In a process according to the present invention, furthermore, the vacuum established in the furnace during heating is maintained substantially at the same value until the hot vacuumized atmosphere in the furnace is cooled down to a predetermined value upon completion of the heating treatment. This is important because the relatively rough surface of the coating of the fluorine-containing resin melted on the surface of the substrate during the heating step is gradually smoothed as the atmosphere in the furnace cools down toward the predetermined value. This predetermined value is the pre-quenching temperature at which the quenching of the coating with an inert gas such as air is to be started and, in a process according to the present invention, preferably ranges from about 310° C. to about 330° C. as above specified. By introduction of the inert gas such as air into the furnace at the start of the quenching treatment, an atmospheric pressure is developed in the furnace so that the fluorine-containing resin still remaining in a somewhat melted state on the surface of the substrate is hardened to form a film having a smooth surface. Introduction of the inert gas into the furnace not only develops an atmospheric pressure in the furnace but contributes to cooling off the coated substrate so that the coating of the fluorine-containing resin is enabled to firmly stick to the surface of the substrate. If the quenching of the fluorine-containing resin is started at a temperature lower than about 310° C., the fluorine-containing resin used will be crystallized and would fail to form a hardened film with a satisfactorily smooth surface as will be discussed in more detail.

DETAILED DESCRIPTION OF THE INVENTION

First Aspect of the Invention

Description will be hereinafter made in regard to the detailed aspects of some modifications of a process according to the present invention, first to the detailed aspects of a process which can be carried out for the formation a film of polytetrafluoroethylene/perfluoropropyl vinyl ether copolymer on the outer peripheral surface of a thermal fixation roll of a duplicating machine.

In a process of forming such a film on the surface of a thermal fixation roll, polytetrafluoroethylene/perfluoropropyl vinyl ether copolymer preferably in the form of fine particles is applied directly to the outer peripheral surface of the metal roll and the resultant roll, with the particles of the copolymer deposited on the surface thereof, is placed into an appropriate vacuum furnace. A partial vacuum of a predetermined degree is developed in the furnace, whereupon the vacuumized atmosphere in the furnace is heated up to a predetermined heating temperature and is maintained at this temperature for a predetermined period of time. Upon lapse of the predetermined period of time, the hot vacuumized atmosphere in the furnace is allowed to cool spontaneously in situ with a vacuum of a desired degree maintained in the furnace until the temperature in the vacuum furnace reaches a predetermined pre-quenching temperature lower than the selected heating temperature. An inert gas at ambient temperature is then introduced into the furnace for quenching the coating on the substrate so that the coating of the polytetrafluoroethylene/perfluoropropyl vinyl ether copolymer formed on the surface of the roll is enabled to firmly adhere to the surface of the roll. The inert gas used as the quenching medium may be air or nitrogen gas.

A number of thermal fixation rolls for duplicating machines were fabricated in the laboratory as specimens to evaluate each of the specimens for the strength of adhesion of the hardened film to the surface of the roll. The rolls used as the substrates were of an aluminum alloy and measured 60 mm in diameter and 320 mm in length. The outer peripheral surfaces of the rolls were preliminarily sand blasted and fine particles of polytetrafluoroethylene/perfluoropropyl vinyl ether copolymer were applied uniformly to the surfaces of the rolls thus roughened. The rolls, or substrates, were suspended in furnaces vacuumized to different degrees of about $10^{-3}$, $10^{-1}$, 30, 100, 380 and 760 Torr by the use of ordinary vacuum pumps. The vacuumized atmosphere in each of the furnaces was then heated up to each of the predetermined heating temperatures of about 420° C., 400° C., 390° C., 380° C., 360° C. and 330° C. and was thereafter maintained at each of these temperatures for predetermined periods of time. The coated rolls in the furnaces were thus heated and accordingly the coatings of the polytetrafluoroethylene/perfluoropropyl vinyl ether copolymer particles on the rolls fused approximately at each of these temperatures. In about 45 minutes after the heating of the furnaces was started, heating was terminated and the furnaces allowed to cool spontaneously with the vacuums in the furnaces maintained at the same degrees until the hot vacuumized atmosphere in the furnaces cooled down to certain pre-quenching temperatures (within the range of from about 310° C. to about 360° C. as will be discussed later). When these pre-quenching temperatures were reached in the furnaces, the vacuum pumps were brought to a stop and atmospheric air was introduced into the furnaces to quench the coatings on the rolls in each of the furnaces. The films of polytetrafluoroethylene/perfluoropropyl vinyl ether copolymer thus formed on the outer peripheral surfaces of the individual rolls were about 20 microns to about 50 microns thick.

Some of the specimens obtained in this manner were treated in boiling water under the pressure of 1.2 atm for about 60 minutes in autoclaves. Adhesion tests conforming to JIS-D-0202 were conducted with the specimens including those thus treated, to evaluate each of the specimens for the strength of adhesion of the hardened film to the surface of the substrate. For this purpose, a number of cross cut lines were scored at intervals of 2 mm in the hardened film of each of the specimens and an ordinary adhesive tape was cut into pieces. These pieces of adhesive tape were applied to the film of each specimen and were then forcefully stripped therefrom twenty times at the same location of the film to see if the film was peeled off from the surface of the substrate. Table 1 shows the results of these adhesion tests, wherein the specimens represented by "A" are those not subjected to treatment in boiling water and the specimens represented by "B" are those treated in boiling water. The sign "o" indicates that the specimen has been determined to be acceptable in its strength of adhesion to the surface of the substrate while the sign "x" indicates that the specimen has proved to be unacceptable in its strength of adhesion to the surface of the substrate.

TABLE 1

| Heating Temperature | Specimen | Degree of Vacuum, Torr $10^{-3}$ | $10^{-1}$ | 30 | 100 | 380 | 760 |
|---|---|---|---|---|---|---|---|
| 420° C. | A | o | o | o | o | o | o |
| | B | o | o | o | o | o | o |
| 400° C. | A | o | o | o | o | o | o |
| | B | o | o | o | o | x | x |
| 390° C. | A | o | o | o | o | o | o |
| | B | o | o | o | o | x | x |
| 380° C. | A | o | o | o | o | o | o |
| | B | o | o | o | o | x | x |
| 360° C. | A | o | o | o | o | o | o |
| | B | o | o | o | o | x | x |
| 330° C. | A | o | o | o | o | o | o |
| | B | o | o | o | o | x | x |

The results of the tests shown in Table 1 indicate that almost all of the specimens tested are acceptable in respect of the strength of adhesion of the hardened films to the surfaces of the substrates.

Among the specimens placed on these tests, those obtained by using the heating temperatures of about 400° C., 380° C. and 360° C. under the vacuums of about $10^{-3}$ Torr and about 760 Torr (1 atm) were further tested to evaluate the hardness of the films on the substrates. Table 2 shows the results of these additional tests, wherein the degree of hardness of each of the specimens is expressed in terms of Vickers hardness number (in kilograms per square millimeters).

TABLE 2

| Heating Temperature | Degree of Vacuum, Torr $10^{-3}$ | 760 |
|---|---|---|
| 400° C. | 5.28 | 4.41 |
| 380° C. | 5.08 | 4.39 |
| 360° C. | 5.77 | 3.30 |

The results of the tests shown in Table 2 indicate that the films of the polytetrafluoroethylene/perfluoropropyl vinyl ether copolymer heated under the vacuum of about $10^{-3}$ Torr are higher by about 11.5 to about 12 percent (at 1 atm) than the films of the same material heated under the vacuum of about 760 Torr at any of the different heating temperatures.

Thermal fixation rolls similar to those used for the above described adhesion tests were further fabricated in the laboratory as specimens to evaluate each of the specimens for the hardness of the film on the substrate. These rolls were heated in furnaces vacuumized to about $2\times10^{-3}$, $5\times10^{-1}$, 30, 100, 380 and 760 in Torr. The vacuumized atmosphere in each of the furnaces was heated up to each of the predetermined temperatures of about 420° C., 400° C., 390° C., 380° C., 360° C. and 330° C. and was thereafter maintained at each of these temperatures for about 45 minutes. The furnaces were then allowed to cool spontaneously with the vacuums in the furnaces maintained at the same degrees until the hot vacuumized atmosphere in the furnaces cooled down through about 20° C. to pre-quenching temperatures of about 400° C., 380° C., 370° C., 360° C., 340° C. and 310° C., respectively, for the above mentioned heating temperatures. Atmospheric air was thereafter introduced into the furnaces to quench the coatings on the rolls in the furnaces. The films of the polytetrafluoroethylene/perfluoropropyl vinyl ether copolymer thus formed on the outer peripheral surfaces of the individual rolls were also about 20 microns to about 50 microns thick.

Tests were conducted with the specimens thus obtained, to evaluate each of the specimens for the hardness of the film on the substrate thereof. Table 3 shows the results of these tests, wherein the degree of hardness of the film is expressed in terms of pencil lead hardness.

TABLE 3

| Heating Temperature | Degree of Vacuum, Torr | | | | | |
|---|---|---|---|---|---|---|
| | $2\times10^{-3}$ | $5\times10^{-1}$ | 30 | 100 | 380 | 760 |
| 420° C. | HB | HB | HB | HB | B | B |
| 400° C. | H | H | HB | B | B | B |
| 390° C. | H | H | HB | B | B | B |
| 380° C. | H | H | HB | B | B | B |
| 360° C. | H | H | B | B | B | 2B |
| 330° C. | H | H | B | B | 2B | 2B |

Specimens of thermal fixation rolls were further fabricated to determine the abrasion resistances of the films of the polytetrafluoroethylene/perfluoropropyl vinyl ether copolymer on the substrates thereof. The specimens of one group were fabricated with the films on the rolls heated at the temperature of about 360° C. under the vacuum of about $2\times10^{-3}$ Torr for about 45 minutes and quenched when the hot vacuumized atmosphere in the furnaces cooled down to the pre-quenching temperature of about 320° C. The specimens of the other group were fabricated with the films on the rolls heated at the temperature of about 360° C. under the vacuum of about 760 Torr for about 45 minutes and quenched when the hot vacuumized atmosphere in the furnaces cooled down to the pre-quenching temperature of about 320° C. Abrasion resistance tests were conducted with these two groups of specimens by the Taber abrasion resistance testing method (largely conforming to the testing method of ASTM D 1044) using weights of 500 grams. The tests revealed that the Taber abrasion resistance index is about 10.6 milligrams per 1000 turns for the former group of specimens and about 12.6 milligrams per 1000 turns for the former group of specimens, showing again that the use of higher degrees of vacuum during heating provide better results.

In an attempt to determine a preferable range of pre-quenching temperatures at which the quenching of the coatings of the polytetrafluoroethylene/perfluoropropyl vinyl ether copolymer is to be started, thermal fixation rolls were further fabricated as specimens to evaluate each of the specimens for the surface roughness of the film on the substrate. The rolls, which were also similar to those used for the above described adhesion tests, were coated with fine particles of polytetrafluoroethylene/perfluoropropyl vinyl ether copolymer and were placed in furnaces vacuumized to different degrees of about $2\times10^{-3}$, $5\times10^{-1}$, 30 and 100 in Torr. The vacuumized atmosphere in each of the furnaces was then heated up to the temperature of about 420° C. and was maintained at this temperature for about 45 minutes. Upon termination of the heating treatment, application of heat to the furnaces was stopped and some of the furnaces were immediately made open to the atmosphere to quench the coatings on the rolls in the furnaces at the temperature of 420° C. The other furnaces were allowed to cool spontaneously with the vacuums in the furnaces maintained at the same degrees until the hot vacuumized atmosphere in the furnaces cooled down to the pre-quenching temperatures of about 400° C., 380° C., 360° C., 340° C. and 310° C., respectively. When these pre-quenching temperatures were reached in the furnaces, atmospheric air was introduced into the furnaces to quench the coatings on the rolls in each of the furnaces. The films of the polytetrafluoroethylene/perfluoropropyl vinyl ether copolymer thus formed on the outer peripheral surfaces of the individual rolls were also about 20 microns to about 50 microns thick.

Tests were conducted with the specimens thus obtained, to evaluate each of the specimens for the surface roughness of the hardened film on the substrate thereof. Table 4 shows the results of these tests, wherein the surface roughness of the film is expressed in terms of root-means-square-average values (Hrms) of the peak-to-valley heights.

TABLE 4

| Pre-quenching Temperature | Degree of Vacuum, Torr | | | |
|---|---|---|---|---|
| | $2\times10^{-3}$ | $5\times10^{-1}$ | 30 | 100 |
| 420° C. | 1.2–1.4 | 1.2–1.3 | 1.1–1.2 | 0.7–0.8 |
| 400° C. | 1.1–1.3 | 1.0–1.1 | 0.9–1.1 | 0.6–0.7 |
| 380° C. | 1.0–1.2 | 0.9–1.1 | 0.6–0.7 | 0.5–0.7 |
| 360° C. | 0.5–0.8 | 0.5–0.8 | 0.5–0.7 | 0.5–0.7 |
| 340° C. | 0.5–0.7 | 0.5–0.7 | 0.5–0.7 | 0.5–0.7 |
| 310° C. | 0.8–0.9 | 0.7–0.8 | 0.7–0.8 | 0.6–0.7 |
| 300° C. | 1.1–1.3 | 0.9–1.2 | 0.9–1.1 | 0.7–0.9 |

From the results of the tests shown in Table 4, it is seen that excellent surface roughness characteristics are achieved when quenching of the coatings of the polytetrafluoroethylene/perfluoropropyl vinyl ether copolymer is started at temperatures ranging from about 310° C. to about 360° C.

On the basis of the results of the tests hereinbefore demonstrated in Tables 1 to 3, it has been determined to be advantageous that the coating of polytetrafluoroethylene/perfluoropropyl vinyl ether copolymer applied to the surface of a thermal fixation roll be heated at a temperature within the range of from about 330° C. to about 400° C. under the vacuum of a degree within the range of from the order of $10^{-3}$ Torr to the order of $10^{-1}$ Torr. From the results of the tests shown in Table 4, it has also been determined to be advantageous that the quenching of the heated coating on the roll through introduction of an inert gas or atmospheric air be started when the hot vacuumized atmosphere in the vacuum furnace is cooled down to a pre-quenching temperature within the range of from about 310° C. to about 360° C.

In accordance with the first outstanding aspect of the present invention, a process of forming a hardened film of polytetrafluoroethylene/perfluoropropyl vinyl ether copolymer on the surface of a thermal fixation roll is, thus, carried out preferably in the following manner.

Used as the substrate is a thermal fixation roll of, for example, aluminum, an aluminum alloy, copper, a copper alloy, or a ferroalloy such as steel. The outer peripheral surface of the roll is preferably degreased and roughened by sand blasting, chemical etching, or electrolytic etching the surface. Where sand blasting is preferred, grits of, for example, alumina known as alundum particles are blown against the degreased surface of the roll and the surface of the roll thus roughened is cleaned by blowing compressed air against the surface or by rinsing the roll in water to purge dust particles therefrom. If desired, the roughened surface of the roll may be anodized to form an oxidized corrosion resistant layer thereon.

Fine particles of polytetrafluoroethylene/perfluoropropyl vinyl ether copolymer are then applied directly to the roughened outer peripheral surface of the metal roll and the resultant roll is fixedly placed in a vacuum furnace. The roll in the vacuum furnace is preferably suspended by means of a suitable hanger so that the roll can be heated uniformly and efficiently by radiation and convection of heat within the furnace. A partial vacuum of a predetermined degree within the range of from about $10^{-3}$ Torr to about $10^{-1}$ Torr is developed in the furnace through use of a suitable vacuum pump. Thereupon the vacuumized atmosphere in the furnace is heated up to a predetermined heating temperature within the range of from about 330° C. to about 400° C. and is thereafter maintained at this temperature for a predetermined period of time of, for example, from about 40 minutes to 60 minutes. Upon lapse of the predetermined period of time, the heated metal roll is allowed to cool spontaneously in situ with the vacuum of the predetermined degree maintained in the vacuum furnace until the temperature in the furnace reaches a predetermined pre-quenching temperature within the range of from about 310° C. to about 360° C. When this pre-quenching temperature is reached, the vacuum pump is brought to a stop and an inert gas such as atmospheric air or nitrogen gas at ambient temperature is introduced into the furnace. The coating on the roll is thus cooled rapidly and is quenched to firmly adhere to the surface of the roll. Where the roll is of iron, a ferroalloy, copper or a copper alloy which may be oxidized when contacted by air at an elevated temperature, the inert gas to be introduced into the furnace as the quenching medium should be nitrogen gas.

The features of the first outstanding aspect of a process according to the present invention will be more clearly understood from the following Examples I-I to I-V of the process.

EXAMPLE I-I

Thermal fixation rolls of an aluminum alloy each measuring about 60 mm in diameter and about 320 mm in length were used as the substrates. The outer peripheral surface of each of the rolls was degreased with tetrachloroethylene and the degreased surface was roughened by sand blasting with alundum particles (of the grain size number 80). The surfaces of the rolls thus degreased and roughened were cleaned by blowing compressed air against the surfaces to purge dust particles therefrom. Fine particles of polytetrafluoroethylene/perfluoropropyl vinyl ether copolymer were then applied uniformly to the entire roughened outer peripheral surface of each of the aluminum-alloy rolls by means of a commercially available electrostatic powder coating machine and the resultant rolls were hung in a vacuum furnace. A partial vacuum of about $10^{-3}$ Torr was developed in the furnace through use of an ordinary vacuum pump. The vacuumized atmosphere in the furnace was then heated up to the temperature of about 390° C. and was thereafter maintained at this temperature for about 60 minutes. Upon lapse of this period of time, heating of the furnace was terminated and the heated aluminum-alloy rolls in the furnaces were allowed to cool spontaneously in situ with the vacuum of about $10^{-3}$ Torr maintained in the furnace until the temperature in the furnace reached the pre-quenching temperature of about 340° C. When this pre-quenching temperature was reached, the vacuum pump was brought to a stop and atmospheric air at ambient temperature was introduced into the furnace to have the coating on each of the rolls in the furnace quenched, whereupon all the rolls were removed from the furnace. The hardened films of the polytetrafluoroethylene/perfluoropropyl vinyl ether copolymer thus formed on the outer peripheral surfaces of the rolls were approximately 40 microns thick and had the surface roughnesses of 0.5 to 0.7 in root-mean-square-average value and the hardness of the grade H of the pencil lead hardness. Adhesion tests were conducted twenty times at the same location of the film of each of the rolls using of an ordinary adhesive tape in a manner described previously, revealing that all of the specimens tested were acceptable. Scratch resistance tests were further conducted by finger nails with scratch lines formed in the film with use of a knife and also showed excellent results.

EXAMPLE I-II

Thermal fixation rolls of copper each measuring about 60 mm in diameter and about 405 mm in length were used as the substrates. The outer peripheral surface of each of the rolls was degreased, roughened and cleaned in manners similar to those used in Example I-I. Fine particles of polytetrafluoroethylene/perfluoropropyl vinyl ether copolymer were then applied uniformly to the entire roughened outer peripheral surface of each of the copper rolls and the resultant rolls were hung in a vacuum furnace. A partial vacuum of about $10^{-3}$ Torr was developed in the furnace through use of a vacuum pump. The vacuumized atmosphere in the furnace was then heated up to the temperature of about 380° C. and was thereafter maintained at this temperature for about 40 minutes. Upon lapse of this period of time, heating of the furnace was terminated and the heated copper rolls in the furnaces were allowed to cool spontaneously in situ with the vacuum of about $10^{-3}$ Torr maintained in the furnace until the temperature in the furnace reached the pre-quenching temperature of about 310° C. When this pre-quenching temperature was reached, the vacuum pump was brought to a stop and nitrogen gas of an ambient temperature was introduced into the furnace to have the coating on each of the rolls in the furnace quenched. The furnace was kept closed for about 15 minutes in order to protect the hot copper rolls in the furnace from being oxidized with the oxygen in the atmospheric air, whereupon all the rolls were removed from the furnace when the atmosphere in the furnace was found to have cooled down to 170° C. The hardened films of the polytetrafluoroethylene/perfluoropropyl vinyl ether copolymer thus formed on the outer peripheral surfaces of the rolls were approximately 45 microns thick and had the surface roughnesses of 0.8 to 0.9 in root-mean-square-average value and the hardness of the grade H of the pencil lead hardness. Adhesion tests were conducted twenty times at the same location of the film of each of the rolls using an adhesive tape in a manner described previously, revealing that all of the specimens tested were acceptable. Scratch resistance tests were further conducted by finger nails and also showed excellent results. Incidentally, there was observed no oxidation of the substrate of copper for each of the rolls.

EXAMPLE I-III

Thermal fixation rolls of an aluminum alloy each measuring about 60 mm in diameter and about 405 mm in length were used as the substrates. The outer peripheral surface of each of the rolls was degreased, roughened and cleaned in manners similar to those used in Example I-I. Fine particles of polytetrafluoroethylene/-perfluoropropyl vinyl ether copolymer were then applied uniformly to the entire roughened outer peripheral surface of each of the aluminum-alloy rolls and the resultant rolls were hung in a vacuum furnace. A partial vacuum of about $5\times10^{-1}$ Torr was developed in the furnace through use of a vacuum pump. The vacuumized atmosphere in the furnace was then heated up to the temperature of about 390° C. and was thereafter maintained at this temperature for about 45 minutes. Upon lapse of this period of time, heating of the furnace was terminated and the heated aluminum-alloy rolls in the furnaces were allowed to cool spontaneously in situ with the vacuum of about $5\times10^{-1}$ Torr maintained in the furnace until the temperature in the furnace reached the pre-quenching temperature of about 360° C. When this pre-quenching temperature was reached, the vacuum pump was brought to a stop and atmospheric air at ambient temperature was introduced into the furnace to have the coating on each of the rolls in the furnace quenched as in Example I-I, whereupon all the rolls were removed from the furnace. The hardened films of the polytetrafluoroethylene/perfluoropropyl vinyl ether copolymer thus formed on the outer peripheral surfaces of the rolls were approximately 20 microns thick and had the surface roughnesses of 0.5 to 0.8 in root-mean-square-average value and the hardness of the grade H of the pencil lead hardness. Adhesion tests were conducted twenty times at the same location of the film of each of the rolls with use of an adhesive tape in a manner described previously, revealing that all of the specimens tested were acceptable. Scratch resistance tests were further conducted by finger nails and also showed excellent results.

EXAMPLE I-V

Thermal fixation rolls of steel each measuring about 30 mm in diameter and about 275 mm in length were used as the substrates. The outer peripheral surface of each of the rolls was degreased, roughened and cleaned also in manners similar to those used in Example I-I. Fine particles of polytetrafluoroethylene/perfluoropropyl vinyl ether copolymer were then applied uniformly to the entire roughened outer peripheral surface of each of the steel rolls and the resultant rolls were hung in a vacuum furnace. A partial vacuum of about $5\times10^{-1}$ Torr was developed in the furnace through use of a vacuum pump. The vacuumized atmosphere in the furnace was then heated up to the temperature of about 380° C. and was thereafter maintained at this temperature for about 60 minutes. Upon lapse of this period of time, heating of the furnace was terminated and the heated steel rolls in the furnaces were allowed to cool spontaneously in situ with the vacuum of about $5\times10^{-1}$ Torr maintained in the furnace until the temperature in the furnace reached the pre-quenching temperature of about 340° C. When this pre-quenching temperature was reached, the vacuum pump was brought to a stop and atmospheric air at ambient temperature was introduced into the furnace to have the coating on each of the rolls in the furnace quenched as in Example I-I, whereupon all the rolls were removed out of the furnace. The hardened films of the polytetrafluoroethylene/perfluoropropyl vinyl ether copolymer thus formed on the outer peripheral surfaces of the rolls were approximately 30 microns thick and had the surface roughnesses of 0.5 to 0.6 in root-mean-square-average value and the hardness of the grade H of the pencil lead hardness. Adhesion tests were conducted twenty times at the same location of the film of each of the rolls using an adhesive tape in a manner described previously, revealing that all of the specimens tested were acceptable. Scratch resistance tests were further conducted by finger nails and also showed excellent results.

Second Aspect of the Invention

Description will be hereinafter made in regard to the detailed aspects of another modification of a process according to the present invention as adapted for the formation a film of a fluorine-containing resin on the surface of a casting, specifically of aluminum or an aluminum alloy, of any of cooking utensils such as kettles, pots and pans.

In a process of forming such a film on a surface of an aluminum or aluminum-alloy casting, the surface of the casting is degreased, roughened by sand blasting and thereafter anodized in an appropriate manner to form a oxidized corrosion resistant layer thereon. A fluorine-containing resin preferably in the form of fine particles is applied directly to the surface of the aluminum or aluminum alloy casting and the resultant casting, with the particles of the fluorine-containing resin deposited on the surface thereof, is placed into an appropriate vacuum furnace. A partial vacuum of a predetermined degree is developed in the furnace, whereupon the vacuumized atmosphere in the furnace is heated up to a predetermined temperature and is maintained at this temperature for a predetermined period of time. Upon lapse of the predetermined period of time, the hot vacuumized atmosphere in the furnace is allowed to cool spontaneously in situ with a vacuum of a desired degree maintained in the furnace until the temperature in the vacuum furnace reaches a predetermined pre-quenching temperature lower than the selected heating temperature. An inert gas at ambient temperature is then introduced into the furnace for quenching the coating on the substrate so that the coating of the fluorine-containing resin formed on the surface of the casting is enabled to firmly adhere to the surface of the casting. The inert gas used as the quenching medium may be air or a nitrogen gas.

A number of aluminum-alloy castings adapted to form pots or pans were fabricated in laboratory as specimens to evaluate each of the specimens for the strength of adhesion of the hardened film to the surface of the casting. The castings used as the substrates were of circular plates of an aluminum alloy (Alcoa 2S) measuring 400 mm in diameter and 1.2 mm in thickness. These castings were first degreased in an ordinary manner with use of a solution of methyl ethyl ketone. The degreased surfaces of the casting were roughened by sand blasting with alundum particles (of the grain size number of 60 to 100). The surfaces of the plates thus degreased and roughened were rinsed in water to remove dust particles therefrom. With the plain opposite surfaces of the castings masked with an appropriate material, each of the castings was immersed in a mixture of sodium hydroxide (NaOH), an aqueous solution of hydrogen peroxide and sodium tripolyphosphate ($Na_5P_3O_{10}$) and was anodized under appropriate conditions, forming an anode-oxidized corrosion resistant layer of about 6 micron thickness on the surface of each casting. The aluminum-alloy castings thus anodized were treated in boiling water to seal the porosities in the roughened and oxidized surfaces of the plates. Upon drying, fine particles of polytetrafluoroethylene/perfluoropropyl vinyl ether copolymer were applied uniformly to the oxidized surfaces of the castings by electro-deposition. The castings were suspended in furnaces vacuumized to different degrees of about $10^{-3}$, $10^{-1}$, 30, 100, 380 and 760 in Torr by the use of ordinary vacuum pumps. The vacuumized atmosphere in each of the furnaces was then heated up to each of the predetermined heating temperatures of about 420° C., 400° C., 390° C., 380° C., 360° C. and 330° C. and was thereafter maintained at each of these temperatures for predetermined periods of time of about 30 minutes on the average. The coated castings in the furnace were thus heated and accordingly the coatings of the particles of the polytetrafluoroethylene/perfluoropropyl vinyl ether copolymer on the castings fused approximately at each of these temperatures. In about 30 minutes after the heating of the furnaces was started, heating was terminated and the furnaces allowed to cool spontaneously with the vacuums in the furnaces maintained at the above specified degrees until the hot vacuumized atmosphere in the furnaces was cooled down to certain pre-quenching temperatures within the range of from about 360° C. to about 310° C. When these temperatures were reached in the furnaces, the vacuum pumps were brought to a stop and atmospheric air was introduced into the furnaces to quench the coatings on the castings in each of the furnaces. The films of the polytetrafluoroethylene/perfluoropropyl vinyl ether copolymer thus formed on the surfaces of the individual castings were about 40±3 microns.

Some of the specimens obtained in these manners were treated in boiling water under the pressure of 1.2 atm for about 60 minutes in autoclaves. Adhesion tests conforming to JIS-D-0202 were conducted with the specimens including those thus treated in a manner previously described, to evaluate each of the specimens for the strength of adhesion of the hardened film to the surface of the aluminum-alloy substrate. The results of these adhesion tests were largely similar to those shown in Table 1. Thus, the results of the tests conducted as above described have revealed that almost all of the specimens tested are acceptable in respect of the strength of adhesion to the surfaces of the substrates.

Among the specimens placed on these tests, those obtained by using the heating temperatures of, particularly, about 400° C., 380° C. and 360° C. under the vacuums of about $10^{-3}$ Torr and about 760 Torr (1 atm) were further tested to evaluate the hardness of the films on the substrates. The results of these additional tests were also largely similar to those shown in Table 2 and have thus revealed that the films of the polytetrafluoroethylene/perfluoropropyl vinyl ether copolymer heated under the vacuum of about $10^{-3}$ Torr are higher than the films heated under the vacuum of about 760 Torr at any of the different heating temperatures.

Aluminum-alloy castings similar to those used for the above described adhesion tests were further fabricated in the laboratory as specimens to evaluate each of the specimens for the hardness of the film on the substrate. The surfaces of the castings were preliminarily sand blasted and fine particles of polytetrafluoroethylene/perfluoropropyl vinyl ether copolymer were applied to the surfaces of the castings thus roughened. The resultant aluminum-alloy castings were placed into furnaces vacuumized to different degrees of about $2\times10^{-3}$, $5\times10^{-1}$, 30, 100, 380 and 760 in Torr. The vacuumized atmosphere in each of the furnaces was then heated up to each of the predetermined temperatures of about 420° C., 400° C., 390° C., 380° C., 360° C. and 330° C. and was thereafter maintained at each of these temperatures. In about 30 minutes after the heating of the furnaces was started, heating was terminated and the furnaces allowed to cool spontaneously with the vacuums in the furnaces maintained at the same degrees until the hot vacuumized atmosphere in the furnaces cooled down to pre-quenching temperatures which are predetermined respectively for the above mentioned heating temperatures. These pre-quenching temperatures are as follows:

TABLE 5

| Heating temp.,° C. | 420 | 400 | 390 | 380 | 360 | 330 |
|---|---|---|---|---|---|---|
| Pre-quenching temp.,° C. | 360 | 360 | 350 | 330 | 320 | 310 |

When these pre-quenching temperatures were reached in the furnaces, the furnaces were made open to the air and atmospheric air was introduced into the furnaces to quench the coatings on the aluminum-alloy castings in each of the furnaces. The films of the polytetrafluoroethylene/perfluoropropyl vinyl ether copolymer thus formed on the surfaces of the individual castings were also from about 40 microns to about 50 microns thick.

Tests were conducted with the specimens thus obtained, to evaluate each of the specimens for the hardness of the film on the substrate thereof. The results of these tests are shown in Table 6 below.

TABLE 6

| Heating Temperature | Degree of Vacuum, Torr | | | | | |
|---|---|---|---|---|---|---|
| | $10^{-3}$ | $10^{-1}$ | 30 | 100 | 380 | 760 |
| 420° C. | HB | HB | HB | HB | B | B |
| 400° C. | H | H | HB | B | B | B |
| 390° C. | H | H | HB | B | B | B |
| 380° C. | H | H | HB | B | B | B |
| 360° C. | H | H | B | B | B | 2B |
| 330° C. | H | H | B | B | 2B | 2B |

The specimens used in these tests were further evaluated for the presence of stains and discolored spots on the hardened films of the polytetrafluoroethylene/perfluoropropyl vinyl ether copolymer on the substrates of the aluminum-alloy castings. Table 7 below shows the results of the evaluation.

TABLE 7

| Heating Temperature | Degree of Vacuum, Torr | | | | | |
|---|---|---|---|---|---|---|
| | $2 \times 10^{-3}$ | $5 \times 10^{-1}$ | 30 | 100 | 380 | 760 |
| 420° C. | o | o | x | x | x | x |
| 400° C. | o | o | x | x | x | x |
| 390° C. | o | o | x | x | x | x |
| 380° C. | o | o | x | x | x | x |
| 360° C. | o | o | x | x | x | x |
| 330° C. | o | o | x | x | x | x |

Specimens of aluminum-alloy castings were further fabricated to determine the abrasion resistances of the films of the polytetrafluoroethylene/perfluoropropyl vinyl ether copolymer on the substrates thereof. The specimens were fabricated using the heating temperature of about 360° C. and the pre-quenching temperature of 320° C. and include those heated under the vacuum of about $2\times10^{-3}$ Torr and those heated under the vacuum of about 760 Torr. The results of the abrasion resistance tests conducted by the Taber abrasion resistance testing method also showed that the use of higher degrees of vacuum during heating provides better results.

To determine an optimum range of the pre-quenching temperatures for the coatings of polytetrafluoroethylene/perflouropropyl vinyl ether copolymer on aluminum-alloy castings for kettles, pots and pans, castings of an aluminum alloy were further fabricated as specimens to evaluate each of the specimens for the surface roughness of the film on the substrate. The coatings of the polytetrafluoroethylene/perfluoropropyl vinyl ether copolymer were heated at the temperature of about 420° C. in furnaces vacuumized to about $2\times10^{-3}$, $5\times10^{-1}$, 30 and 100 in Torr for about 30 minutes. Upon termination of the heating treatment, application of heating to the furnaces was stopped and some of the furnaces were immediately made open to the atmosphere to quench the coatings on the castings in the furnaces at the temperature of 420° C. The other furnaces were allowed to cool spontaneously with the vacuums in the furnaces maintained at the above specified degrees until the hot vacuumized atmosphere in the furnaces cooled down to the pre-quenching temperatures of about 400° C., 380° C., 360° C., 340° C. and 310° C., respectively. When these pre-quenching temperatures were reached in the furnaces, atmospheric air was introduced into the furnaces to quench the coatings on the substrates in each of the furnaces. The films of the polytetrafluoroethylene/perfluoropropyl vinyl ether copolymer thus formed on the surfaces of the castings were also from about 40 microns to about 50 microns. Tests were conducted with the specimens thus obtained, to evaluate each of the specimens for the surface roughness of the hardened film on the substrate thereof. The results of these tests are largely similar to those shown in Table 4 previously presented. From the results of these tests, it is also known that excellent surface roughness characteristics are achieved when the quenching treatment of the coatings of the polytetrafluoroethylene/perfluoropropyl vinyl ether copolymer is started at temperatures ranging from about 310° C. to about 360° C.

On the basis of the results of the tests conducted with the aluminum-alloy castings coated with the polytetrafluoroethylene/perfluoropropyl vinyl ether copolymer, it has been determined to be advantageous that the coating of a fluorine-containing resin applied to the surface of an aluminum or aluminum-alloy casting be heated at a temperature within the range of from about 330° C. to about 400° C. under the vacuum of a degree within the range of from the order of $10^{-3}$ Torr to the order of $10^{-1}$ Torr. From the results of the surface roughness tests as above described, it has also been determined to be advantageous that the quenching of the heated coating on an aluminum or aluminum-alloy casting through introduction of an inert gas or atmospheric air be started when the hot vacuumized atmosphere in the vacuum furnace is cooled down to a pre-quenching temperature within the range of from about 310° C. to about 360° C.

In accordance with the second outstanding aspect of the present invention, a process of forming a hardened film of a fluorine-containing resin on the surface of an aluminum or aluminum-alloy casting is, thus, carried out preferably in the following manner.

Used as the substrate is a casting of aluminum or an aluminum alloy. The surface of the aluminum or aluminum-alloy casting is preferably degreased and roughened by, for example, sand blasting. Where sand blasting is preferred, grits of, for example, alumina are blown against the degreased surface of the casting and the surface of the casting thus roughened is cleaned by blowing compressed air against the surface or by rinsing the casting in water to purge dust particles therefrom. The roughened surface of the casting is further preferably anodized to form an oxidized corrosion resistant layer thereon and the resultant casting is treated in boiling water or with steam under pressure to seal off the porosities formed in the surface of the casting by the anodizing treatment.

Fine particles of a fluorine-containing resin, are then applied directly to the roughened and oxidized surface of the aluminum or aluminum alloy casting by spraying or electrodeposition and the resultant casting is fixedly placed in a vacuum furnace. The casting in the vacuum furnace is preferably suspended by means of a suitable hanger so that the casting can be heated uniformly and efficiently by radiation and convection of heat within the furnace. A partial vacuum of a predetermined degree within the range of from the order of $10^{-3}$ Torr to the order of $10^{-1}$ Torr is developed in the furnace through use of a suitable vacuum pump. Thereupon the vacuumized atmosphere in the furnace is heated up to a predetermined temperature within the range of from about 330° C. to about 400° C. and is thereafter maintained at this temperature for a predetermined period of time of, for example, from about 30 minutes to 60 minutes. Upon lapse of the predetermined period of time, the heated aluminum or aluminum alloy casting is allowed to cool spontaneously in situ with the vacuum of the predetermined degree maintained in the vacuum furnace until the temperature in the furnace reaches a predetermined pre-quenching temperature within the range of from about 310° C. to about 360° C. When this pre-quenching temperature is reached, the vacuum pump is brought to a stop and an inert gas such as atmospheric air at ambient temperature is introduced into the furnace. The coating of the fluorine-containing resin on the aluminum or aluminum-alloy casting is thus cooled rapidly and is quenched to firmly adhere to the surface of the casting.

The aluminum or aluminum-alloy plates having the coatings of a fluorine-containing resin thus fabricated can be readily deformed into the form of, for example, saucepans by the use of, for example, a hydraulic press with the inner surfaces of the pans formed by the coated surfaces of the castings. If desired, blanks of aluminum or an aluminum alloy may be preliminarily deformed into the desired form of, for example, kettles, pots or pans and processed to form a hardened coating of a fluorine-containing resin on the anodized inner surface or on each of the anodized inner and outer surfaces of the blank in a manner above described.

The features of the second outstanding aspect of a process according to the present invention will be more clearly understood from the following Examples II-I to II-III of the process.

EXAMPLE II-I

Flat circular plates of an aluminum alloy (Alcoa 3S) each measuring about 400 mm in diameter and about 1.2 mm in thickness were used as the substrates. The opposite surfaces of each of the plates were degreased in an ordinary manner and one of the degreased surfaces was roughened by sand blasting with alundum particles (of the grain size number 80). The surfaces of the plates thus degreased and roughened were rinsed in water to remove dust particles therefrom. With the plain outer surfaces of the plates masked with an appropriate material, each of the plates was immersed in 0.2 mol per liter of sodium hydroxide (NaOH) solution with additives of 2 percent of a 35 percent aqueous solution of hydrogen peroxide and 0.05 percent of sodium tripolyphosphate ($Na_5P_3O_{10}$) and was anodized using the voltage of 40 volts and the current density of 2.5 A/dm$^2$ for about 8 minutes with the temperature of the electrolytic solution maintained at 13° C., forming anode-oxidized corrosion resistant layers of about 3 micron thickness. The aluminum-alloy plates thus anodized were treated in boiling water to seal the porosities in the roughened and oxidized surfaces of the plates. Upon drying, fine particles of polytetrafluoroethylene/perfluoropropyl vinyl ether copolymer were applied uniformly to the entire roughened and oxidized peripheral surface of each of the aluminum-alloy plates by means of an ordinary electrostatic powder coating machine and the resultant plates were hung in a vacuum furnace. A partial vacuum of about $2\times10^{-3}$ Torr was developed in the furnace through use of an ordinary vacuum pump. The vacuumized atmosphere in the furnace was then heated up to the temperature of about 400° C. and was thereafter maintained at this temperature for about 30 minutes. Upon lapse of this period of time, heating of the furnace was terminated and the heated aluminum-alloy plates in the furnaces were allowed to cool spontaneously in situ with the vacuum of about $2\times10^{-3}$ Torr maintained in the furnace until the temperature in the furnace reached the pre-quenching temperature of about 350° C. When this pre-quenching temperature was reached, the vacuum pump was brought to a stop and atmospheric air at ambient temperature was introduced into the furnace to have the coating on each of the plates in the furnace quenched, whereupon all the plates were removed out of the furnace. The hardened films of the polytetrafluoroethylene/perfluoropropyl vinyl ether copolymer thus formed on the oxidized surfaces of the aluminum-alloy plates were approximately 40 microns thick and had the surface roughnesses of 0.5 to 0.7 in root-mean-square-average value and the hardness of the grade H of the pencil lead hardness. Adhesion tests were conducted twenty times at the same location of the film of each of the plates with use of an adhesive tape in a manner described previously, revealing that all of the specimens tested were acceptable. Scratch resistance tests were further conducted by finger nails and also showed excellent results.

The circular aluminum-alloy plates used in this Example II-I were deformed into the form of saucepans measuring 200 mm in diameter and 120 mm in depth by the use of a hydraulic press, with no objectionable symptoms observed. The plain outer surfaces of the saucepans thus obtained were anodized in a solution of sulfuric acid to form oxidized layers of about 6 micron thickness and were thereafter treated in boiling water to seal the porosities resulting from the anodic oxidation. No unusual symptoms were observed on the inner and outer surfaces of the saucepans when the pans thus processed were put to actual use.

EXAMPLE II-II

Generally cylindrical castings of an aluminum alloy (S 7A, ASTM B 26-68) in the forms of saucepans each measuring about 210 mm in diameter and about 110 mm in depth were used as the substrates. The inner surface of each of the castings was degreased in an ordinary manner and the surface thus degreased was roughened by sand blasting with alundum particles (of the grain size number 80). The surfaces of the castings thus degreased and roughened were rinsed in water to remove dust particles therefrom. With the plain outer surfaces of the castings masked with an appropriate material, each of the castings was immersed in 0.2 mol per liter of sodium hydroxide solution with additives of 2 percent of a 35 percent aqueous solution of hydrogen peroxide and 0.05 percent of sodium tripolyphosphate and was anodized using the voltage of 40 volts and the current density of 2.5 A/dm$^2$ for about 13 minutes with the temperature of the electrolytic solution maintained at 13° C., forming anode-oxidized corrosion resistant layers of about 5 micron thickness. The aluminum-alloy castings thus anodized were immersed in boiling water to seal the porosities in the roughened and oxidized surfaces of the castings. Subsequently, fine particles of polytetrafluoroethylene/perfluoropropyl vinyl ether copolymer were applied uniformly to the entire roughened and oxidized inner surfaces of each of the aluminum-alloy castings by means of an electrostatic powder coating machine and the resultant castings were hung in a vacuum furnace. A partial vacuum of about $5\times10^{-1}$ Torr was developed in the furnace through use of a vacuum pump. The vacuumized atmosphere in the furnace was then heated up to the temperature of about 390° C. and was thereafter maintained at this temperature for about 40 minutes. Upon lapse of this period of time, heating of the furnace was terminated and the heated aluminum-alloy castings in the furnaces were allowed to cool spontaneously in situ with the vacuum of about $5\times10^{-1}$ Torr maintained in the furnace until the temperature in the furnace reached the pre-quenching temperature of about 340° C. When this pre-quenching temperature was reached, the vacuum pump was brought to a stop and atmospheric air of an ambient temperature was introduced into the furnace to have the coating on each of the castings in the furnace quenched, whereupon all the castings were removed from the furnace. The hardened films of the polytetrafluoroethylene/perfluoropropyl vinyl ether copolymer thus formed on the oxidized surfaces of the aluminum-alloy castings were approximately 45 microns thick and had the surface roughnesses of 0.6 to 0.7 in root-mean-square-average value and the hardness of the grade H of the pencil lead hardness. Adhesion tests were conducted twenty times at the same location of the film of each of the castings with use of an adhesive tape in a manner described previously, revealing that all of the specimens tested were acceptable. Scratch resistance tests were further conducted by finger nails and also showed excellent results. Furthermore, no unusual symptoms were observed on the inner surfaces of the saucepans when the pans thus processed were put to actual use with salt-seasoned meat boiled in water at about 95° C. for 100 hours.

EXAMPLE II-III

Generally cylindrical castings of an aluminum alloy (Alcoa 3S) in the forms of saucepans each measuring about 250 mm in diameter, about 150 mm in depth and about 1.2 mm in thickness were used as the substrates. The inner surface of each of the castings was degreased in an ordinary manner and the surface thus degreased was roughened by sand blasting with alundum particles (of the grain size number 80). The surfaces of the castings thus degreased and roughened were rinsed in water to remove dust particles therefrom. With the plain outer surfaces of the castings masked with an appropriate material, each of the castings was immersed in the mixture of 0.1 mol per liter of sodium carbonate ($Na_2CO_3$), 0.1 mol per liter of sodium fluoride (NaF), 0.1 mol per liter of sodium tartrate ($Na_2C_4H_4O_6$) and was anodized using the a.c. voltage of 20 volts for about 10 minutes, forming anode-oxidized corrosion resistant layers each of about 5 micron thickness. Steam under pressure was blown against the anode-oxidated surfaces of these aluminum-alloy castings to seal the porosities in the oxidized surfaces of the castings. Subsequently, fine particles of polytetrafluoroethylene/polyhexafluomopropylene copolymer were applied uniformly to the entire inner surfaces of each of the aluminum-alloy castings and the resultant castings were hung in a vacuum furnace. A partial vacuum of about $2\times10^{-3}$ Torr was developed in the furnace through use of a vacuum pump. The vacuumized atmosphere in the furnace was then heated up to the temperature of about 350° C. and was thereafter maintained at this temperature for about 45 minutes. Upon lapse of this period of time, heating of the furnace was terminated and the heated aluminum-alloy castings in the furnaces were allowed to cool in situ with the vacuum of about $2\times10^{-3}$ Torr maintained in the furnace until the temperature in the furnace reached the pre-quenching temperature of about 310° C. When this pre-quenching temperature was reached, the vacuum pump was brought to a stop and atmospheric air at ambient temperature was introduced into the furnace to quench the coating on each of the castings in the furnace, whereupon all the castings were removed from the furnace. The hardened films of the polytetrafluoroethylene/polyhexafluoroprpylene copolymer thus formed on the oxidized surfaces of the aluminum-alloy castings were approximately 40 microns thick and had the surface roughnesses of 0.8 to 0.9 in root-mean-square-average value and the hardness of the grade H of the pencil lead hardness. Adhesion tests were conducted twenty times at the same location of the film of each of the castings with use of an adhesive tape in a manner described previously, revealing that all of the specimens tested were acceptable. Scratch resistance tests were further conducted by finger nails and also showed excellent results. Furthermore, no unusual symptoms were observed on the inner surfaces of the saucepans when the pans thus processed were put to actual use in boiling water for a 100 hour period.

Third Aspect of the Invention

Description will be hereinafter made in regard to the detailed aspects of a third modification of a process according to the present invention as carried out for the formation of a film of polytetrafluoroethylene on the surface of any of certain kinds of machine components of precision, optical and other machines and equipment such as precision cutting knives or blades of metal and non-metal working machines and fins of heat exchangers, certain kinds of precision articles of metal such as needles of syringes, and component members of some machines and equipment such as certain kinds of soldering jigs and molds for forming thermoplastic and thermosetting plastics. It should however be noted that the process to be described hereinafter is also adapted for the formation of a film of polytetrafluoroethylene on the surface of a casting not requiring strict control of the shapes and sizes such as a cooking vessel of aluminum or an aluminum alloy.

In a process of forming a film of polytetrafluoroethylene on a surface of a metallic substrate to form any of the above mentioned kinds of coated metallic articles, the surface of the substrate is first degreased and roughened by, for example, sand blasting. The substrate may be of iron, aluminum, copper, a ferroalloy, an aluminum alloy or a copper alloy and, where aluminum or an aluminum alloy in particular is used, the degreased and roughened substrate is preferably anodized in an appropriate manner to form an oxidized corrosion resistant layer on the roughened surface of the substrate. A dispersed solution of polytetrafluoroethylene is applied directly to the surface of the substrate by spraying or by electrodeposition and the resultant substrate, with the coating of polytetrafluoroethylene on the surface thereof, is placed into an appropriate vacuum furnace. A partial vacuum of a predetermined degree is developed in the furnace, whereupon the vacuumized atmosphere in the furnace is heated up to a predetermined temperature and is maintained at this temperature for a predetermined period of time. Upon lapse of the predetermined period of time, the hot vacuumized atmosphere in the furnace is allowed to cool spontaneously in situ with a vacuum of a desired degree maintained in the furnace until the temperature in the vacuum furnace reaches a pre-quenching temperature lower by a predetermined value within a predetermined range of temperature than the selected heating temperature. An inert gas at ambient temperature is then introduced into the furnace for quenching the coating on the substrate so that the coating of polytetrafluoroethylene formed on the surface of the substrate is enabled to firmly adhere to the roughened and oxidized surface of the substrate. The inert gas used as the quenching medium may be air or nitrogen gas. The hardened film of polytetrafluoroethylene thus formed on the metallic substrate in accordance with the third outstanding aspect of the present invention is approximately 5 microns to 15 microns thick.

A number of metallic substrates adapted to form precision articles were fabricated in the laboratory as specimens to evaluate each of the specimens for the strength of adhesion of the hardened film to the surface of the substrate. The substrates used were circular plates of aluminum, mild steel, stainless steel and brass. These metallic plates were first degreased in an ordinary manner with use of a solution of methyl ethyl ketone. The degreased surfaces of the substrate were roughened by sand blasting with alundum particles (of the grain size number of 60 to 100). The surfaces of the plates thus degreased and roughened were rinsed in water to remove dust particles therefrom. Upon drying, fine particles of polytetrafluoroethylene were applied uniformly to the roughened surfaces of the plates by electrodeposition. The plates were suspended in furnaces vacuumized to about $10^{-3}$ Torr by the use of ordinary vacuum pumps. The vacuumized atmosphere in each of the furnaces was then heated up to each of the predetermined temperatures of about 420° C., 400° C., 380° C. and 360° C. and was thereafter maintained at each of these temperatures for predetermined periods of time. The coated substrates in the furnaces were thus heated and accordingly the coatings of polytetrafluoroethylene on the substrates fused approximately at each of these temperatures. In about 30 minutes after the heating of the furnaces was started, heating was terminated and some of the furnaces were made open to the atmosphere to quench the coatings of the plates therein with atmospheric air. The other furnaces were allowed to cool spontaneously with the vacuums in the furnaces maintained at the same degree until the hot vacuumized atmosphere in the furnaces cooled down to certain pre-quenching temperatures. When these temperatures were reached in the furnaces, the vacuum pumps were brought to a stop and atmospheric air was introduced into the furnaces to quench the coatings on the plates in each of the furnaces. The hardened films of polytetrafluoroethylene thus formed on the surfaces of the individual substrates were from about 5 microns to about 15 microns thick.

Some of the specimens obtained in these manners were treated in boiling water under the pressure of 1.2 atom for about 15 minutes in autoclaves. Adhesion tests conforming to JIS-D-0202 were conducted with the specimens including those thus treated in a manner previously described, to evaluate each of the specimens for the strength of adhesion of the hardened film to the surface of the substrate. The results of these adhesion tests are shown in Table 8 below, wherein the specimens represented by "A" are those not subjected to treatment in boiling water and the specimens represented by "B" are those treated in boiling water.

TABLE 8

| Heating temp. | Pre-quenching temp. | Aluminum | Soft steel | Stainless steel | Brass |
|---|---|---|---|---|---|
| 420° C. | 420° C. | o x | x x | o x | x x |
| | 400° C. | o x | x x | o x | o x |
| | 380° C. | o o | o x | o o | o o |
| | 360° C. | o o | o x | o o | o o |
| | 340° C. | o o | o o | o o | o o |
| | 320° C. | o o | o o | o o | o o |
| | 280° C. | x x | o o | o o | o x |
| | 240° C. | x x | o o | o x | o x |
| 400° C. | 400° C. | o x | x x | o x | o x |
| | 380° C. | o x | x x | o x | o x |
| | 360° C. | o o | o x | o o | o o |
| | 340° C. | o o | o o | o o | o o |
| | 320° C. | o o | o o | o o | o o |
| | 280° C. | x x | o o | o o | x x |
| | 240° C. | x x | o o | o x | x x |
| 380° C. | 380° C. | o x | x x | o x | x x |
| | 360° C. | o o | x x | o o | o x |
| | 340° C. | o o | o x | o o | o o |
| | 320° C. | o o | o o | o o | o o |
| | 280° C. | x x | o o | o o | o o |

TABLE 8-continued

| Heating temp. | Pre-quenching temp. | Aluminum | Soft steel | Stainless steel | Brass |
|---|---|---|---|---|---|
| | 240° C. | x x | o o | o x | x x |
| 360° C. | 360° C. | x x | x x | x x | x x |
| | 340° C. | x x | x x | x x | x x |
| | 360° C. | x x | x x | x x | x x |
| | 280° C. | x x | x x | x x | x x |
| | 240° C. | x x | x x | x x | x x |

From the results shown in Table 8, it is seen that, when the coatings on the substrates are heated at the temperature of 420° C., satisfactory adhesion resistances can be achieved when the quenching of the coatings are started at temperatures ranging from about 320° C. to about 380° C. for all of the materials used but unacceptable adhesion resistances result from the quenching of the coatings started at the temperatures of 400° C. or more or 280° C. or less for many of the materials used. When the heating temperature of 420° C. and the pre-quenching temperatures of 400° C. and 420° C. were used, the results of the adhesion resistance tests on the specimens subjected to treatment in boiling water (specimen "B") showed that the films were peeled off by the fifteenth try of the adhesive tape tests. When, on the other hand, the coatings on the substrates are heated at the temperature of 400° C., satisfactory adhesion resistances can be achieved when the quenching of the coatings are started at temperatures ranging from about 320° C. to about 360° C. for almost all of the materials used but unacceptable adhesion resistances result from the quenching of the coatings started at the temperatures of 380° C. or more or 280° C. or less for many of the materials used. When the heating temperature of 400° C. and the pre-quenching temperatures of 380° C. and 400° C. were used, the results of the adhesion resistance tests on the specimens subjected to treatment in boiling water showed that the films were peeled off by the fifth to fifteenth tries of the adhesive tape tests. When, furthermore, the coatings on the substrates are heated at the temperature of 380° C., satisfactory adhesion resistances can be achieved when the quenching of the coatings are started at temperatures ranging from about 280° C. to about 340° C. for most of the materials used but unacceptable adhesion resistances result from the quenching of the coatings started at the temperatures of 360° C. or more or 240° C. or less for many of the materials used. When the heating temperature of 380° C. and the pre-quenching temperatures of 360° C. and 380° C. were used, the results of the adhesion resistance tests on the specimens subjected to treatment in boiling water also showed that the films were peeled off by the fifth to fifteenth tries of the adhesive tape tests. Table 8 further shows that all of the specimens with the coatings heated at the temperature of 360° C. are lacking in acceptable adhesion resistance without respect to the pre-quenching temperatures selected.

Thus, the results of the tests shown in Table 8 indicate that a preferred range of the heating temperatures is from about 380° C. to about 420° C. and that preferred pre-quenching temperatures are lower than the selected heating temperatures by values within the range of from about 40° C. to about 100° C.

Coated metallic articles similar to those used for the above described adhesion tests were further fabricated in the laboratory as specimens to determine a preferred range of the degrees of vacuums to which the vacuum furnaces are to be vacuumized during heating. Plates of an aluminum alloy (Alcoa 2S) measuring 10 mm by 10 mm and 1.6 mm in thickness were used as the substrates and were sand blasted with use of alundum of the grain size 80. The roughened surfaces of the aluminum plates were then coated with a dispersed solution of polytetrafluoroethylene and the resultant aluminum plates were placed into furnaces vacuumized to different degrees of about $10^{-3}$, $10^{-1}$, 30, 100, 380 and 760 in Torr. The vacuumized atmosphere in each of the furnaces was then heated up to each of the predetermined temperatures of about 420° C., 400° C., 390° C., 380° C. and 360° C. and was thereafter maintained at each of these temperatures. In about 30 minutes after the heating of the furnaces was started, heating was terminated and the furnaces allowed to cool spontaneously with the vacuums in the furnaces maintained at the same degrees until the hot vacuumized atmosphere in the furnaces cooled down through about 40° C. The coatings of the articles thus obtained were about 13 microns thick on the average.

Adhesion tests conforming to JIS-D-0202 were conducted with the specimens thus obtained in a manner previously described, the results of the tests being shown in Table 9 below, wherein the specimens represented by "A" are those not subjected to treatment in boiling water and the specimens represented by "B" are those treated in boiling water.

TABLE 9

| Heating Temperature | Specimen | Degree of Vacuum, Torr | | | | | |
|---|---|---|---|---|---|---|---|
| | | $10^{-3}$ | $10^{-1}$ | 30 | 100 | 380 | 760 |
| 420° C. | A | o | o | o | o | o | x |
| | B | o | o | o | o | x | x |
| 400° C. | A | o | o | o | o | x | x |
| | B | o | o | o | o | x | x |
| 390° C. | A | o | o | x | x | x | x |
| | B | o | o | x | x | x | x |
| 380° C. | A | o | x | x | x | x | x |
| | B | o | x | x | x | x | x |
| 360° C. | A | x | x | x | x | x | x |
| | B | x | x | x | x | x | x |

The results of the tests shown in Table 9 indicate that the adhesion resistance of the coatings of the specimens tested depend upon the degrees of vacuum selected as well as the heating temperatures and that the most preferred range of the degrees of vacuum is of the order of $10^{-3}$ Torr although the degrees of vacuum of the order of $10^{-1}$ Torr are also acceptable. Using vacuums of degrees higher than the order of $10^{-3}$ Torr during heating of the films of polytetrafluoroethylene is economically unfeasible in the present state of the art and for this reason has not been included in the tests. It is however considered from the results shown in Table 9 that, in view of the range of the heating temperatures of the atmosphere as ordinarily used in the art, the most preferred range of the degrees of the vacuum to achieve satisfactory strengths of adhesion at the heating temperatures of higher than 380° C. are of the order of $10^{-3}$ Torr. This however does not mean that the degrees of vacuum to be used in the third aspect of a process according to the present invention are limited to the order of $10^{-3}$ Torr. In fact, the results of the tests shown in Table 9 indicate that considerably high adhesion resistances can be achieved when vacuums of the order of $10^{-1}$ or 30 Torr are used.

In accordance with the third outstanding aspect of the present invention, a process of forming a hardened film of polytetrafluoroethylene on the surface of a metallic substrate to form a coated precision article is, thus, carried out preferably in the following manner.

Used as the substrate is a substrate of iron, aluminum, copper, a ferroalloy such as mild steel or stainless steel, an aluminum alloy, or a copper alloy such as brass. The surface of such a substrate is preferably degreased and roughened by, for example, sand blasting. Where aluminum or an aluminum alloy is used as the metallic substrate, the roughened surface of the substrate is preferably anodized to form an oxidized corrosion resistant layer thereon and the resultant substrate is treated in boiling water or with steam under pressure to seal off the porosities formed by the anodizing treatment.

A dispersed solution of polytetrafluoroethylene is then applied directly to the roughened surface of the substrate by spraying or electrodeposition and the resultant substrate is fixedly placed in a vacuum furnace. A partial vacuum of a predetermined degree of the order of $10^{-3}$ Torr is developed in the furnace through use of a suitable vacuum pump. Thereupon the vacuumized atmosphere in the furnace is heated up to a predetermined temperature within the range of from about 380° C. to about 420° C. and is thereafter maintained at this temperature for a predetermined period of time of, for example, about 30 minutes. Upon lapse of the predetermined period of time, the heated substrate is allowed to cool spontaneously in situ with the vacuum of the predetermined degree maintained in the vacuum furnace until the temperature in the furnace reaches a predetermined pre-quenching temperature which is lower than the selected heating temperature by a value within the range of from about 40° C. to about 100° C. When this pre-quenching temperature is reached, the vacuum pump is brought to a stop and an inert gas such as atmospheric air or nitrogen gas at ambient temperature is introduced into the furnace. The coating of polytetrafluoroethylene on the substrate is thus cooled rapidly and is quenched to firmly adhere to the surface of the substrate.

The features of the third outstanding aspect of a process according to the present invention will be more clearly understood from the following Examples III-I to III-VII of the process.

EXAMPLE III-I

Flat rectangular plates of an aluminum alloy (Alcoa 2S) each measuring about 50 mm by 100 mm and about 0.5 mm in thickness were used as the substrates. The opposite surfaces of each of the plates were degreased in an ordinary manner using methyl ethyl ketone. Upon drying, a dispersed solution of polytetrafluoroethylene was applied uniformly to the entire surfaces of each of the aluminum-alloy plates by the use of an ordinary spray gun. After the coatings of polytetrafluoroethylene thus applied were dried in the atmosphere, the aluminum-alloy plates were hung in a vacuum furnace. A partial vacuum of about $2\times10^{-3}$ Torr was developed in the furnace through use of a vacuum pump. The vacuumized atmosphere in the furnace was then heated up to the temperature of about 380° C. and was thereafter maintained at this temperature for about 30 minutes. Upon lapse of this period of time, heating of the furnace was terminated and the heated aluminum-alloy plates in the furnace were allowed to cool spontaneously in situ with the vacuum of about $2\times10^{-3}$ Torr maintained in the furnace until the temperature in the furnace reached the pre-quenching temperature of about 280° C. When this pre-quenching temperature was reached, the vacuum pump was brought to a stop and atmospheric air at ambient temperature was introduced into the furnace to quench the coating on each of the plates in the furnace, whereupon all the plates were removed from the furnace. The hardened films of polytetrafluoroethylene thus formed on the surfaces of the aluminum-alloy plates were approximately 9 microns thick. Adhesion tests were conducted twenty times at the same location of the film of each of the plates using an adhesive tape in a manner described previously, revealing that all of the specimens tested were acceptable. The specimens thus tested were then treated in boiling water for 15 minutes and adhesion tests were further conducted with the resultant specimens, with no unusual symptoms observed.

EXAMPLE III-II

Flat rectangular plates of mild steel each measuring about 50 mm by 100 mm and about 0.4 mm in thickness were used as the substrates. The opposite surfaces of each of the plates were degreased with use of methyl ethyl ketone. Upon drying, a dispersed solution of polytetrafluoroethylene was applied uniformly to the entire surface of each of the mild steel plates by the use of an ordinary spray gun. After the coatings of the polytetrafluoroethylene thus applied were dried in the atmosphere, the mild steel plates were hung in a vacuum furnace. A partial vacuum of about $2\times10^{-3}$ Torr was developed in the furnace through use of an ordinary vacuum pump. The vacuumized atmosphere in the furnace was then heated up to the temperature of about 400° C. and was thereafter maintained at this temperature for about 30 minutes. Upon lapse of this period of time, heating of the furnace was terminated and the heated mild steel plates in the furnace were allowed to cool spontaneously in situ with the vacuum of about $2\times10^{-3}$ Torr maintained in the furnace until the temperature in the furnace reached the pre-quenching temperature of about 360° C. When this pre-quenching temperature was reached, the vacuum pump was brought to a stop and atmospheric air at ambient temperature was introduced into the furnace to quench the coating on each of the plates in the furnace, whereupon all the plates were removed out of the furnace. The hardened films of polytetrafluoroethylene thus formed on the surfaces of the mild steel plates were approximately 8 microns thick. Adhesion tests were conducted twenty times at the same location of the film of each of the plates using an adhesive tape in a manner described previously, revealing that all of the specimens tested were acceptable. The specimens thus tested were then treated in boiling water for 15 minutes and adhesion tests were further conducted with the resultant specimens, with no unusual symptoms observed.

EXAMPLE III-III

Flat rectangular plates of stainless steel (ASTM Type 304) each measuring about 50 mm by 100 mm and about 0.5 mm in thickness were used as the substrates. The opposite surfaces of each of the plates were degreased with use of methyl ethyl ketone. Upon drying, a dispersed solution of polytetrafluoroethylene was applied uniformly to the entire surface of each of the stainless steel plates by the use of a spray gun. After the coatings of polytetrafluoroethylene thus applied were dried in the atmosphere, the stainless steel plates were hung in a vacuum furnace. A partial vacuum of about $2\times10^{-3}$ Torr was developed in the furnace through use of an ordinary vacuum pump. The vacuumized atmosphere in the furnace was then heated up to the temperature of about 420° C. and was thereafter maintained at this temperature for about 30 minutes. Upon lapse of this period of time, heating of the furnace was terminated and the heated stainless steel plates in the furnace were allowed to cool spontaneously in situ with the vacuum of about $2\times10^{-3}$ Torr maintained in the furnace until the temperature in the furnace reached the pre-quenching temperature of about 360° C. When this pre-quenching temperature was reached, the vacuum pump was brought to a stop and atmospheric air at ambient temperature was introduced into the furnace to quench the coating on each of the plates in the furnace, whereupon all the plates were removed from the furnace. The hardened films of polytetrafluoroethylene thus formed on the surfaces of the stainless steel plates were approximately 6 microns thick. Adhesion tests were conducted twenty times at the same location of the film of each of the plates using an adhesive tape in a manner described previously, revealing that all of the specimens tested were acceptable. The specimens thus tested were then treated in boiling water for 15 minutes and adhesion tests were further conducted with the resultant specimens, with no unusual symptoms observed.

EXAMPLE III-IV

Flat rectangular plates of brass each measuring about 50 mm by 100 mm and about 0.6 mm in thickness were used as the substrates. The opposite surfaces of each of the plates were degreased with use of methyl ethyl ketone. Upon drying, a dispersed solution of polytetrafluoroethylene was applied uniformly to the entire surface of each of the brass plates by the use of a spray gun. After the coatings of the polytetrafluoroethylene thus applied were dried in the atmosphere, the brass plates were hung in a vacuum furnace. A partial vacuum of about $2\times10^{-3}$ Torr was developed in the furnace through use of an ordinary vacuum pump. The vacuumized atmosphere in the furnace was then heated up to the temperature of about 400° C. and was thereafter maintained at this temperature for about 30 minutes. Upon lapse of this period of time, heating of the furnace was terminated and the heated brass plates in the furnace were allowed to cool spontaneously in situ with the vacuum of about $2\times10^{-3}$ Torr maintained in the furnace until the temperature in the furnace reached the pre-quenching temperature of about 340° C. When this pre-quenching temperature was reached, the vacuum pump was brought to a stop and atmospheric air at ambient temperature was introduced into the furnace to quench the coating on each of the plates in the furnace, whereupon all the plates were removed from the furnace. The hardened films of polytetrafluoroethylene thus formed on the surfaces of the brass plates were approximately 7 microns thick. Adhesion tests were conducted twenty times at the same location of the film of each of the plates using an adhesive tape in a manner described previously, revealing that all of the specimens tested were acceptable. The specimens thus tested were then treated in boiling water for 15 minutes and adhesion tests were further conducted with the resultant specimens, with no unusual symptoms observed.

EXAMPLE III-V

Flat rectangular plates of brass each measuring about 100 mm by 100 mm and about 1.6 mm in thickness were used as the substrates. The opposite surfaces of each of the plates were degreased with methyl ethyl ketone and the degreased surfaces were roughened by sand blasting with alundum particles (of the grain size number 80). The surfaces of the plates thus degreased and roughened were rinsed in water to remove dust particles therefrom. Upon drying, a dispersed solution of polytetrafluoroethylene was applied uniformly to the entire surface of each of the brass plates using a spray gun. After the coatings of the polytetrafluoroethylene thus applied were dried in the atmosphere, the brass plates were hung in a vacuum furnace. A partial vacuum of about $2\times10^{-3}$ Torr was developed in the furnace through use of a vacuum pump. The vacuumized atmosphere in the furnace was then heated up to the temperature of about 420° C. and was thereafter maintained at this temperature for about 30 minutes. Upon lapse of this period of time, heating of the furnace was terminated and the heated brass plates in the furnace were allowed to cool spontaneously in situ with the vacuum of about $2\times10^{-3}$ Torr maintained in the furnace until the temperature in the furnace reached the pre-quenching temperature of about 360° C. When this pre-quenching temperature was reached, the vacuum pump was brought to a stop and atmospheric air at ambient temperature was introduced into the furnace to quench the coating on each of the plates in the furnace, whereupon all the plates were removed from the furnace. The hardened films of polytetrafluoroethylene thus formed on the surfaces of the brass plates were approximately 12 microns thick. Adhesion tests were conducted twenty times at the same location of the film of each of the plates using of an adhesive tape in a manner described previously, revealing that all of the specimens tested were acceptable. The specimens thus tested were then treated in boiling water for 15 minutes and adhesion tests were further conducted with the resultant specimens, with no unusual symptoms observed. Scratch resistance tests were further conducted by finger nails with lines scored in the hardened films by a knife and also showed excellent results.

EXAMPLE III-VI

Flat rectangular castings of an aluminum alloy (Alcoa Alclad 7A) each measuring about 100 mm by 100 mm and about 3.0 mm in thickness were used as the substrates. The opposite surfaces of each of the castings were degreased using methyl ethyl ketone and the degreased surfaces were roughened by sand blasting with alundum particles (of the grain size number 100). The surfaces of the castings thus degreased and roughened were rinsed in water to remove dust particles therefrom. Upon drying, a dispersed solution of polytetrafluoroethylene was applied uniformly to the entire surface of each of the aluminum-alloy castings using a spray gun. After the coatings of the polytetrafluoroethylene thus applied were dried in the atmosphere, the aluminum-alloy castings were hung in a vacuum furnace. A partial vacuum of about $5\times10^{-3}$ Torr was developed in the furnace through use of a vacuum pump. The vacuumized atmosphere in the furnace was then heated up to the temperature of about 400° C. and was thereafter maintained at this temperature for about 30 minutes. Upon lapse of this period of time, heating of the furnace was terminated and the heated aluminum-alloy castings in the furnace were allowed to cool spontaneously in situ with the vacuum of about $5\times10^{-3}$ Torr maintained in the furnace until the temperature in the furnace reached the pre-quenching temperature of about 340° C. When this pre-quenching temperature was reached, the vacuum pump was brought to a stop and atmospheric air at ambient temperature was introduced into the furnace to quench the coating on each of the castings in the furnace, whereupon all the castings were removed from the furnace. The hardened films of polytetrafluoroethylene thus formed on the surfaces of the aluminum-alloy castings were approximately 13 microns thick. Adhesion tests were conducted twenty times at the same location of the film of each of the castings using an adhesive tape in a manner described previously, revealing that all of the specimens tested were acceptable. The specimens thus tested were then treated in boiling water for 15 minutes and adhesion tests were further conducted with the resultant specimens, with no unusual symptoms observed. Scratch resistance tests were further conducted by finger nails with lines scored in the hardened films by a knife and also showed excellent results. The specimens were thereafter treated in a boiling 5% aqueous solution of salt for about 40 hours but no unusual symptoms were observed on the surfaces of the specimens.

EXAMPLE III-VII

Flat rectangular plates of stainless steel (ASTM Type 304) each measuring about 50 mm by 100 mm and about 2.0 mm in thickness were used as the substrates. The opposite surfaces of each of the plates were degreased using methyl ethyl ketone and the degreased surfaces were roughened by sand blasting with alundum particles (of the grain size number 60). The surfaces of the plates thus degreased and roughened were rinsed in water to remove dust particles therefrom. Upon drying, each of the stainless steel plates was immersed in an electrolytic solution consisting of a dispersed solution of polytetrafluoroethylene. A d.c. voltage of 10 volts was applied to each of the plates as the cathode electrode for 15 seconds so that a coating of polytetrafluoroethylene was deposited uniformly on the entire surface of each of the stainless steel plates. After the coatings of polytetrafluoroethylene thus applied were dried in the atmosphere, the stainless steel plates were hung in a vacuum furnace. A partial vacuum of about $2\times10^{-3}$ Torr was developed in the furnace through use of an ordinary vacuum pump. The vacuumized atmosphere in the furnace was then heated up to the temperature of about 380° C. and was thereafter maintained at this temperature for about 30 minutes. Upon lapse of this period of time, heating of the furnace was terminated and the heated stainless steel plates in the furnace were allowed to cool spontaneously in situ with the vacuum of about $2\times10^{-3}$ Torr maintained in the furnace until the temperature in the furnace reached the pre-quenching temperature of about 340° C. When this pre-quenching temperature was reached, the vacuum pump was brought to a stop and atmospheric air at ambient temperature was introduced into the furnace to quench the coating on each of the plates in the furnace, whereupon all the plates were removed out of the furnace. The hardened films of polytetrafluoroethylene thus formed on the surfaces of the stainless steel plates were approximately 14 microns thick. Adhesion tests were conducted twenty times at the same location of the film of each of the plates using an adhesive tape in a manner described previously, revealing that all of the specimens tested were acceptable. The specimens thus tested were then treated in boiling water for 15 minutes and adhesion tests were further conducted with the resultant specimens, with no unusual symptoms observed. Scratch resistance tests were further conducted by finger nails with lines scored in the hardened films by a knife and also showed excellent results. The specimens were thereafter treated in a boiling 5% aqueous solution of salt for about 40 hours but no unusual symptoms were observed on the surfaces of the specimens.

The hardened film of polytetrafluoroethylene thus formed on the metallic substrate in accordance with the third outstanding aspect of the present invention is approximately 5 microns to 15 microns thick. Such a film of polytetrafluoroethylene can be formed advantageously on a substrate of, for example, aluminum, an aluminum alloy, mild steel, stainless steel or brass of a desired thickness. The process may include the step of degreasing the substrate or the steps of degreasing and roughening the surface of the substrate prior to the step of coating the substrate with a dispersed solution of polytetrafluoroethylene. The process including the step of degreasing but not the step of roughening the surface of the substrate is advantageous for the formation of a film of polytetrafluoroethylene to the thickness of from about 5 microns to about 10 microns on a metallic substrate of a thickness less than 0.6 mm. In this instance, the film formed on the substrate will not only contribute to increasing mechanical strength and the resistance to deformation of the substrate but provide ease of controlling the thickness of the film and adequate degrees of adhesion to substrate, non-stickiness, surface-to-surface fitness, smoothness and water repellency. Examples of the products using such films of polytetrafluoroethylene include certain kinds of machine components of precision, optical and other machines and equipment such as precision cutting knives or blades of metal and non-metal working machines and fins of heat exchangers, and certain kinds of precision articles of metal such as needles of syringes. On the other hand, the process including the steps of both degreasing and roughening the surface of the substrate is advantageous for the formation of a film of polytetrafluoroethylene to the thickness of from about 10 microns to about 15 microns on a metallic substrate of a thickness more than 0.6 mm. In this instance, the film formed on the substrate will provide not only adequate degrees of adhesion to substrate, non-stickiness, surface-to-surface fitness, smoothness and water repellency but increased degrees of wear and abrasion resistances, scratch resistance, corrosion resistance, and resistances to stress and strain. Examples of the products using such films of polytetrafluoroethylene include soldering jigs and molds for forming thermoplastic and thermosetting plastics.

What is claimed is:

1. A process of forming a film of a fluorine-containing resin on a surface of a metallic substrate, comprising the steps of (a) coating the surface of the metallic substrate with said fluorine-containing resin, (b) placing the coated metallic substrate in a vacuum furnace, (c) developing in said vacuum furnace a partial vacuum of a predetermined degree within a range containing the order of $10^{-3}$ Torr, (d) heating the vacuumized atmosphere in the furnace at a predetermined heating temperature of the range of from about 330° C. to about 420° C. for a predetermined period of time, (e) upon lapse of said predetermined period of time, allowing the hot vacuumized atmosphere in the furnace to cool spontaneously while maintaining a vacuum within said range in the furnace until the temperature in the furnace reaches a predetermined pre-quenching temperature lower than said predetermined heating temperature, (f) introducing an inert gas at ambient temperature into said furnace for quenching the coating on the substrate.

2. A process of forming a film of polytetrafluoroethylene/perfluoropropyl vinyl ether copolymer on a surface of a metallic substrate, comprising the steps of (a) coating the surface of the metallic substrate with polytetrafluoroethylene/perfluoropropyl vinyl ether copolymer, (b) placing the coated metallic substrate in a vacuum furnace, (c) developing in said vacuum furnace a partial vacuum of a predetermined degree within the range of from the order of $10^{-3}$ Torr to the order of $10^{-1}$ Torr, (d) heating the vacuumized atmosphere in the furnace at a predetermined heating temperature of the range of from about 330° C. to about 400° C. for a predetermined period of time, (e) upon lapse of said predetermined period of time, allowing the hot vacuumized atmosphere in the furnace to cool spontaneously while maintaining a vacuum within said range in the furnace until the temperature in the furnace reaches a predetermined pre-quenching temperature lower than said predetermined heating temperature, said predetermined prequenching temperature being within the range of from about 310° C. to about 360° C., (f) introducing an inert gas at ambient temperature into said vacuum furnace for quenching the coating on the substrate.

3. A process as set forth in claim 2, in which the vacuum in the furnace is maintained at said predetermined degree while the hot vacuumized atmosphere in the furnace is allowed to cool upon lapse of said predetermined period of time.

4. A process as set forth in claim 2, in which the vacuumized atmosphere in the furnace is maintained at said predetermined heating temperature for a predetermined period of time within the range of from about 40 minutes to about 60 minutes before the hot vacuumized atmosphere in the furnace is allowed to cool.

5. A process as set forth in claim 4, in which said polytetrafluoroethylene/perfluoropropyl vinyl ether copolymer is applied in the form of particles to the surface of said metallic substrate.

6. A process as set forth in claim 4, in which said metallic substrate is constructed of a material selected from the group consisting of iron, aluminum, copper, ferroalloys, aluminum alloys and copper alloys.

7. A process as set forth in claim 4, further comprising the step of roughening the surface of said metallic substrate prior to the step of coating the surface with polytetrafluoroethylene/perfluoropropyl vinyl ether copolymer.

8. A process as set forth in claim 7, further comprising the step of degreasing the surface of said metallic substrate prior to the step of roughening the surface of the substrate.

9. A process as set forth in claim 4, in which said metallic substrate is constructed of a material selected from aluminum and aluminum alloys, the process further comprising the step of anodizing the surface of said metallic substrate prior to the step of coating the surface of the metallic substrate with said fluorine-containing resin and after the step of roughening the surface of the substrate.

10. A process of forming a film of a fluorine-containing resin on a surface of an aluminum or aluminum-alloy substrate, said fluorine-containing resin being selected from the group consisting of polytetrafluoroethylen/-polyhexafluoropropylene copolymer and polytetrafluoroethylene/perfluoropropyl vinyl ether copolymer, the process comprising (a) roughening the surface of said substrate,
(b) anodizing the roughened surface of the substrate
(c) coating the anodized surface of the substrate with said fluorine-containing resin,
(d) placing the coated substrate in a vacuum furnace,
(e) developing in said vacuum furnace a partial vacuum of a predetermined degree within the range of from the order of $10^{-3}$ Torr to the order of $10^{-1}$ Torr,
(f) heating the vacuumized atmosphere in the furnace at a predetermined heating temperature of the range of from about 330° C. to about 400° C. for a predetermined period of time,
(g) upon lapse of said predetermined period of time, allowing the hot vacuumized atmosphere in the furnace to cool spontaneously while maintaining a vacuum within said range in the furnace until the temperature in the furnace reaches a predetermined pre-quenching temperature lower than said predetermined heating temperature, said predetermined prequenching temperature being within the range of from about 310° C. to about 360° C.,
(h) introducing an inert gas at ambient temperature into said vacuum furnace for quenching the coating on the substrate.

11. A process as set forth in claim 10, in which the vacuum in the furnace is maintained at said predetermined degree while the hot vacuumized atmosphere in the furnace is being allowed to cool upon lapse of said predetermined period of time.

12. A process as set forth in claim 10, in which the vacuumized atmosphere in the furnace is maintained at said predetermined heating temperature for a predetermined period of time within the range of from about 40 minutes to about 60 minutes before the hot vacuumized atmosphere in the furnace is allowed to cool.

13. A process as set forth in claim 12, in which said fluorine-containing resin is applied in the form of particles to the surface of said substrate.

14. A process as set forth in claim 12, further comprising the step of degreasing the surface of said substrate prior to the step of roughening the surface of the substrate.

15. A process as set forth in claim 12, further comprising the step of treating the anodized surface of said substrate with hot water for sealing the porosities in the surface of the substrate prior to the step of coating the surface of the substrate with said fluorine-containing resin.

16. A process of forming a film of polytetrafluoroethylene on a surface of a metallic substrate, comprising the steps of (a) coating the surface of the metallic substrate with polytetrafluoroethylene,
(b) placing the coated metallic substrate in a vacuum furnace,
(c) developing in said vacuum furnace a partial vacuum of a predetermined degree within the range of the order of $10^{-3}$,
(d) heating the vacuumized atmosphere in the furnace at a predetermined heating temperature of the range of from about 380° C. to about 420° C. for a predetermined period of time,
(e) upon lapse of said predetermined period of time, allowing the hot vacuumized atmosphere in the furnace to cool spontaneously while maintaining a vacuum within said range in the furnace until the temperature in the furnace reaches a pre-quenching temperature lower by a predetermined value than said predetermined heating temperature, said predetermined pre-quenching temperature being within the range of from about 310° C. to about 360° C., said predetermined value being within the range of from about 40° C. to about 100° C.,
(f) introducing an inert gas of an ambient temperature into said vacuum furnace for quenching the coating on the substrate.

17. A process as set forth in claim 16, in which the vacuum in the furnace is maintained at said predetermined degree while the hot vacuumized atmosphere in the furnace is being allowed to cool upon lapse of said predetermined period of time.

18. A process as set forth in claim 16, in which the vacuumized atmosphere in the furnace is maintained at said predetermined heating temperature for about 30 minutes before the hot vacuumized atmosphere in the furnace is allowed to cool.

19. A process as set forth in claim 18, in which said polytetrafluoroethylene is applied in the form of a dispersed solution to the surface of said metallic substrate.

20. A process as set forth in claim 18, in which said metallic substrate is constructed of a material selected from the group consisting of iron, aluminum, copper, ferroalloys, aluminum alloys and copper alloys.

21. A process as set forth in claim 18, further comprising the step of roughening the surface of said metallic substrate prior to the step of coating the surface with polytetrafluoroethylene.

22. A process as set forth in claim 21, further comprising the step of degreasing the surface of said metallic substrate prior to the step of roughening the surface of the substrate.

23. A process as set forth in claim 18, in which said metallic substrate is constructed of a material selected from aluminum and aluminum alloys, the process further comprising the step of anodizing the surface of said metallic substrate prior to the step of coating the surface of the metallic substrate with said fluorine-containing resin and after the step of roughening the surface of the substrate.

* * * * *

UNITED STATES PATENT AND TRADEMARK OFFICE

CERTIFICATE OF CORRECTION

PATENT NO. : 4,568,573

DATED : February 4, 1986

INVENTOR(S) : Yukiyoshi SUNADA; Shigeya HANAZONO

It is certified that error appears in the above-identified patent and that said Letters Patent is hereby corrected as shown below:

On the title page, please have the Assignee's name corrected to read as - Nikken Toso Kogyo Company Limited --.

Signed and Sealed this

*Twenty-fourth* Day of *June 1986*

[SEAL]

*Attest:*

DONALD J. QUIGG

*Attesting Officer*

*Commissioner of Patents and Trademarks*